US009096075B2

(12) United States Patent
Nakano et al.

(10) Patent No.: US 9,096,075 B2
(45) Date of Patent: Aug. 4, 2015

(54) PRINTING APPARATUS

(71) Applicant: SEIKO EPSON CORPORATION, Tokyo (JP)

(72) Inventors: Shuichiro Nakano, Matsumoto (JP); Eiji Kumai, Matsumoto (JP); Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/056,453

(22) Filed: Oct. 17, 2013

(65) Prior Publication Data

US 2014/0111587 A1 Apr. 24, 2014

(30) Foreign Application Priority Data

Oct. 19, 2012 (JP) ..... 2012-232421

(51) Int. Cl.
*B41J 2/01* (2006.01)
*B41J 11/00* (2006.01)

(52) U.S. Cl.
CPC ..... *B41J 11/0005* (2013.01); *B41J 11/006* (2013.01)

(58) Field of Classification Search
CPC ..... B41J 11/007; B41J 11/06; B41J 11/0085; B41J 13/103; B41J 11/0065
USPC ..... 347/104, 101
See application file for complete search history.

(56) References Cited

U.S. PATENT DOCUMENTS 6,019,464 A * 2/2000 Tsukada et al. ..... 347/92
2012/0013680 A1* 1/2012 Kitamura et al. ..... 347/30
2012/0120174 A1* 5/2012 Hosoya et al. ..... 347/104

FOREIGN PATENT DOCUMENTS

JP 2012-020467 2/2012

* cited by examiner

*Primary Examiner* — Manish S Shah
*Assistant Examiner* — Yaovi Ameh
(74) *Attorney, Agent, or Firm* — Workman Nydegger

(57) ABSTRACT

A printing apparatus includes: a transportation unit that transports a recording medium having flexibility; a head unit that has a liquid droplet ejection head which ejects an ink onto the recording medium transported by operation of the transportation unit, and a carriage which supports the liquid droplet ejection head; a movement unit that moves the head unit in a direction orthogonal to a transportation direction of the recording medium with respect to the recording medium; and a warpage straightening member that straightens a warpage to disappear when the warpage in a degree to interfere with the head unit which is moved by operation of the movement unit, occurs in the recording medium.

7 Claims, 13 Drawing Sheets

PRINTING APPARATUS

BACKGROUND

1. Technical Field

The present invention relates to a printing apparatus.

2. Related Art

A printing apparatus that imparts an ink to print on a sheet-shaped recording medium having flexibility has been employed in the related art (for example, see JP-A-2012-20467). The printing apparatus described JP-A-2012-20467 includes a transportation mechanism that transports a recording medium, a head unit that applies the ink onto the transported recording medium, and a movement mechanism (driving source) that moves the head unit with respect to the recording medium.

In the printing apparatus described in JP-A-2012-20467, although depending on the use environment (for example, humidity is relatively high and the like), a portion of the recording medium may be inadvertently warped (loosened) during the process of transporting the recording medium. In a case where the aforementioned warpage occurs when performing printing onto the recording medium, if the head unit moves toward the recording medium, the head unit and the warped portion of the recording medium interfere with each other, that is, collide with each other. As a result, there has been a problem that retention (jamming) of the recording medium occurs so as to cause the head unit to be held in suspension in its integrity. In a case where the suspension state of the head unit continues for a relatively long period (for example, one to two hours), clogging occurs in a nozzle port of the head unit that ejects the ink such that the head unit no longer becomes serviceable, thereby forcing a replacement of the head unit.

SUMMARY

An advantage of some aspects of the invention is to provide a printing apparatus in which retention (jamming) can be reliably prevented from occurring due to an inadvertent warp of a recording medium when performing printing onto the recording medium.

The above-mentioned advantage can be achieved by some aspects of the invention described below.

According to an aspect of the invention, there is provided a printing apparatus including: a transportation unit that transports a recording medium having flexibility; a head unit that has a liquid droplet ejection head which ejects an ink onto the recording medium transported by the operation of the transportation unit, and a carriage which supports the liquid droplet ejection head; a movement unit that moves the head unit in a direction intersecting a transportation direction of the recording medium with respect to the recording medium; and a warpage straightening unit that straightens a warpage to disappear when the warpage in a degree to interferes with the head unit which is moved by the operation of the movement unit, occurs in the recording medium.

In this case, when performing printing onto the recording medium, even though the recording medium is inadvertently warped, it is possible to reliably remove the warpage by the warpage straightening unit. Accordingly, it is possible to reliably prevent the retention (jamming) of the recording medium from occurring.

In the printing apparatus according to the aspect of the invention, it is preferable that the warpage straightening unit be provided in the head unit, and configured of a plate member which is arranged to oppose the recording medium when the head unit passes over the recording medium.

In this case, when the head unit passes over the recording medium, the warpage straightening member can reliably straighten the warpage in the recording medium during a process of passing over. Accordingly, it is possible to reliably prevent the retention (jamming) of the recording medium.

In the printing apparatus according to the aspect of the invention, it is preferable that the plate member have pressing sections which press the warpage from an upstream side toward a downstream side in the transportation direction in accordance with the head unit passing over the recording medium.

In this case, the head unit passes over the recording medium, and presses the warpage from the upstream side toward the downstream side in the transportation direction, and thus it is possible to remove the warpage by the pressing. Accordingly, it is possible to prevent operation efficiency of the printing apparatus from being lowered in comparison with a case, for example, where movement of the head unit is suspended for a moment to remove the warpage, and then the movement of the head unit is restarted.

In the printing apparatus according to the aspect of the invention, it is preferable that the movement unit be configured to cause the head unit to reciprocate in a direction intersecting the transportation direction, and the pressing sections be respectively provided on a portion which is located in front of the plate member on an outward route and a portion which is located in front of the plate member on a homeward route.

In this case, the head unit reciprocates over the recording medium, and presses the warpage from the upstream side toward the downstream side in the transportation direction, and thus it is possible to remove the warpage by the pressing. Accordingly, it is possible to prevent the operation efficiency of the printing apparatus from being lowered in comparison with the case, for example, where the movement of the head unit is suspended for a moment to remove the warpage, and then the movement of the head unit is restarted.

In the printing apparatus according to the aspect of the invention, it is preferable that the pressing sections protrude from the head unit in a plan view of the plate member.

In this case, while the head unit is moving, the pressing sections can squash the warpage before the head unit is interfered with the warpage. Accordingly, it is possible to reliably prevent the head unit from being interfered with the warpage.

In the printing apparatus according to the aspect of the invention, it is preferable that the pressing sections have a tilted section that is tilted to form an acute angle at a portion of the downstream side in the transportation direction with respect to a moving direction in a plan view.

In this case, it is possible to easily thrust the tilted section into the upstream side of the warpage. Then, if the head unit moves in its integrity, the warpage is easily and reliably pressed by the tilted section, and thus it is possible to reliably remove the warpage.

In the printing apparatus according to the aspect of the invention, it is preferable that the angle of the tilted section be 50 degrees or greater and 70 degrees or smaller.

In this case, it is possible to more easily thrust the tilted section into the upstream side of the warpage. Then, if the head unit moves in its integrity, the warpage is easily and reliably pressed by the tilted section, and thus it is possible to reliably remove the warpage.

In the printing apparatus according to the aspect of the invention, it is preferable that the pressing sections have a tilted section that is tilted to form an acute angle at a portion opposing the recording medium with respect to a moving direction in a front view in which the plate member is viewed from the downstream side in the transportation direction.

In this case, the head unit can easily surmount a portion of the upstream side from the warpage of the recording medium by the tilted section.

In the printing apparatus according to the aspect of the invention, it is preferable that the angle of the tilted section be 30 degrees or greater and 50 degrees or smaller.

In this case, the head unit can easily surmount a portion of the upstream side from the warpage of the recording medium by the tilted section.

In the printing apparatus according to the aspect of the invention, it is preferable that at least one through hole that passes through the plate member be formed in the plate member, and is configured to allow air to be discharged from between the plate member and the recording medium through the through hole, if the air flows in between the plate member and the recording medium.

In this case, it is possible to reliably prevent curved flying of the ink from occurring by the air flowed inbetween the plate member and the recording medium.

In the printing apparatus according to the aspect of the invention, it is preferable that a guide groove that guides the air toward the through hole be formed in the plate member.

In this case, the air flowed in between the plate member and the recording medium is reliably guided to the through hole by the guide groove, thereby being discharged from the through hole.

According to another aspect of the invention, there is provided a printing apparatus including: a head unit that moves in a travel direction, and ejects an ink onto a recording medium; and a warpage straightening member that is located in front of the head unit in the travel direction.

In this case, even though the recording medium is inadvertently warped when performing printing onto the recording medium, it is possible to reliably remove the warpage by the warpage straightening unit. Accordingly, it is possible to reliably prevent the retention (jamming) of the recording medium from occurring.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printing apparatus of some aspects of the invention will be described in detail based on suitable embodiments illustrated in accompanying drawings.

First Embodiment

Figure 1:
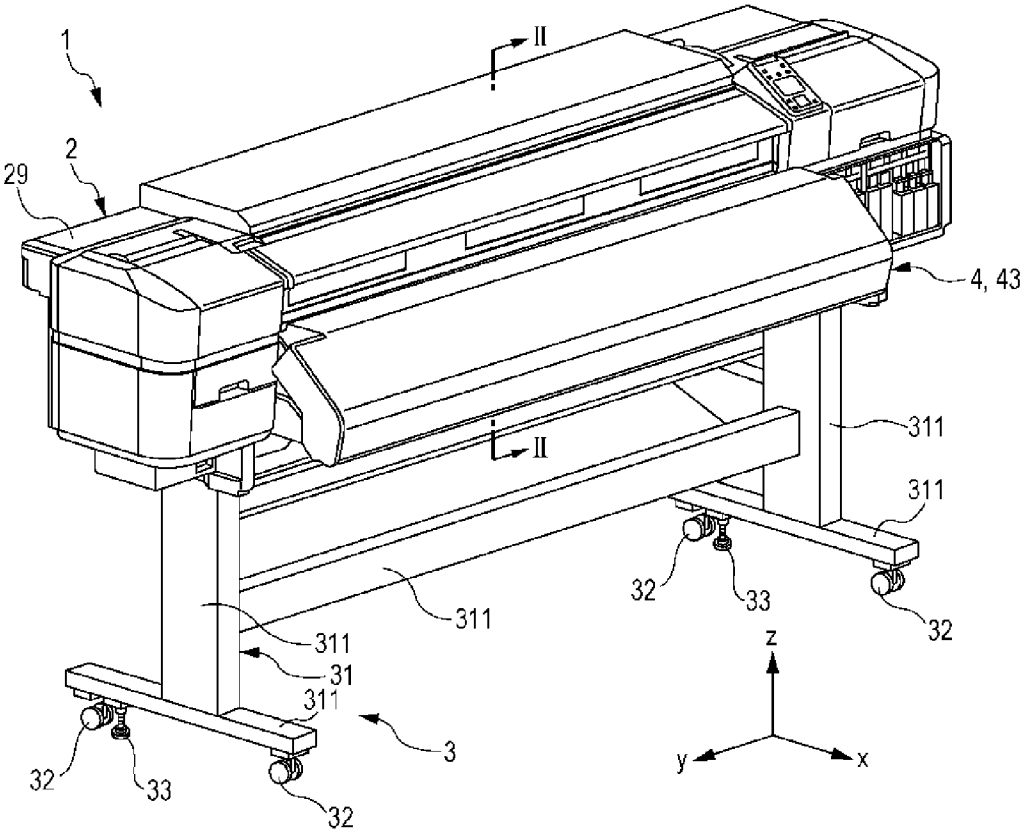
FIG. 1 is a perspective view illustrating a first embodiment of a printing apparatus of an aspect of the invention.
Figure 2:
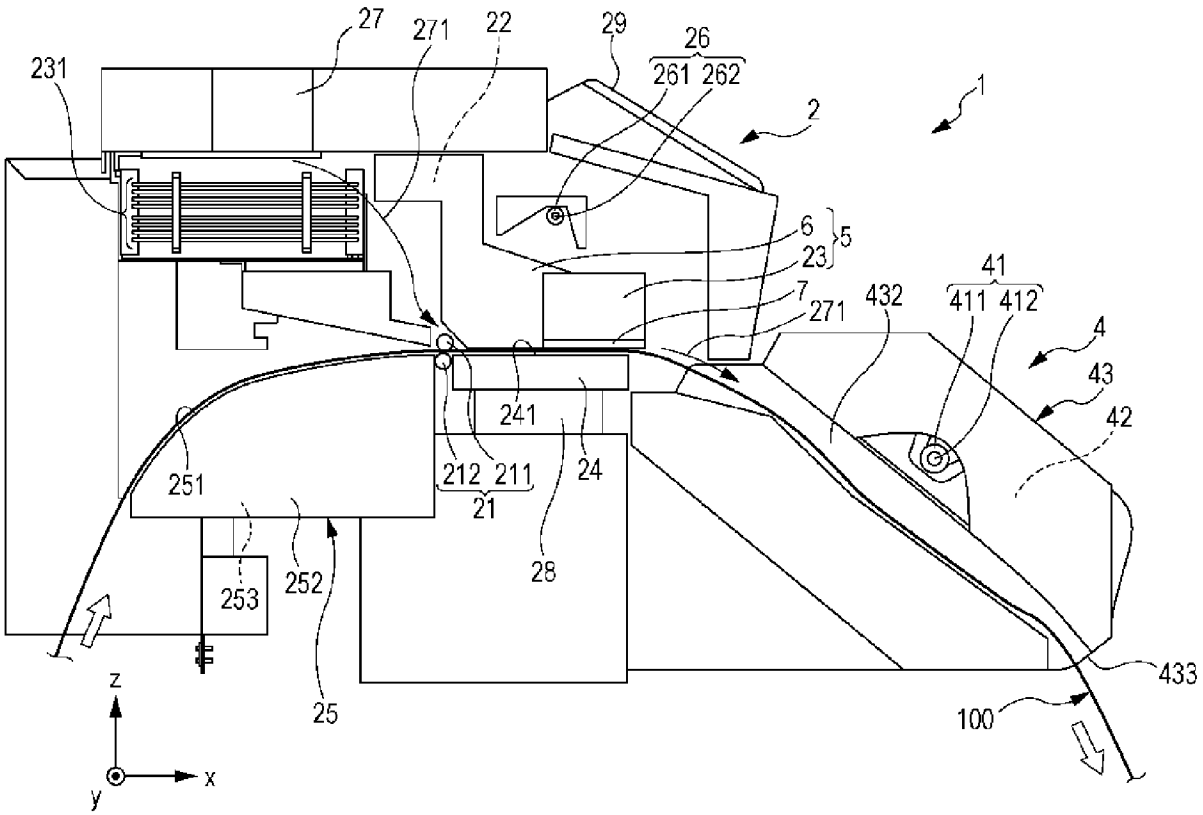
FIG. 2 is a cross-sectional view (schematic cross-sectional view) taken along line II-II in FIG. 1.
Figure 3:
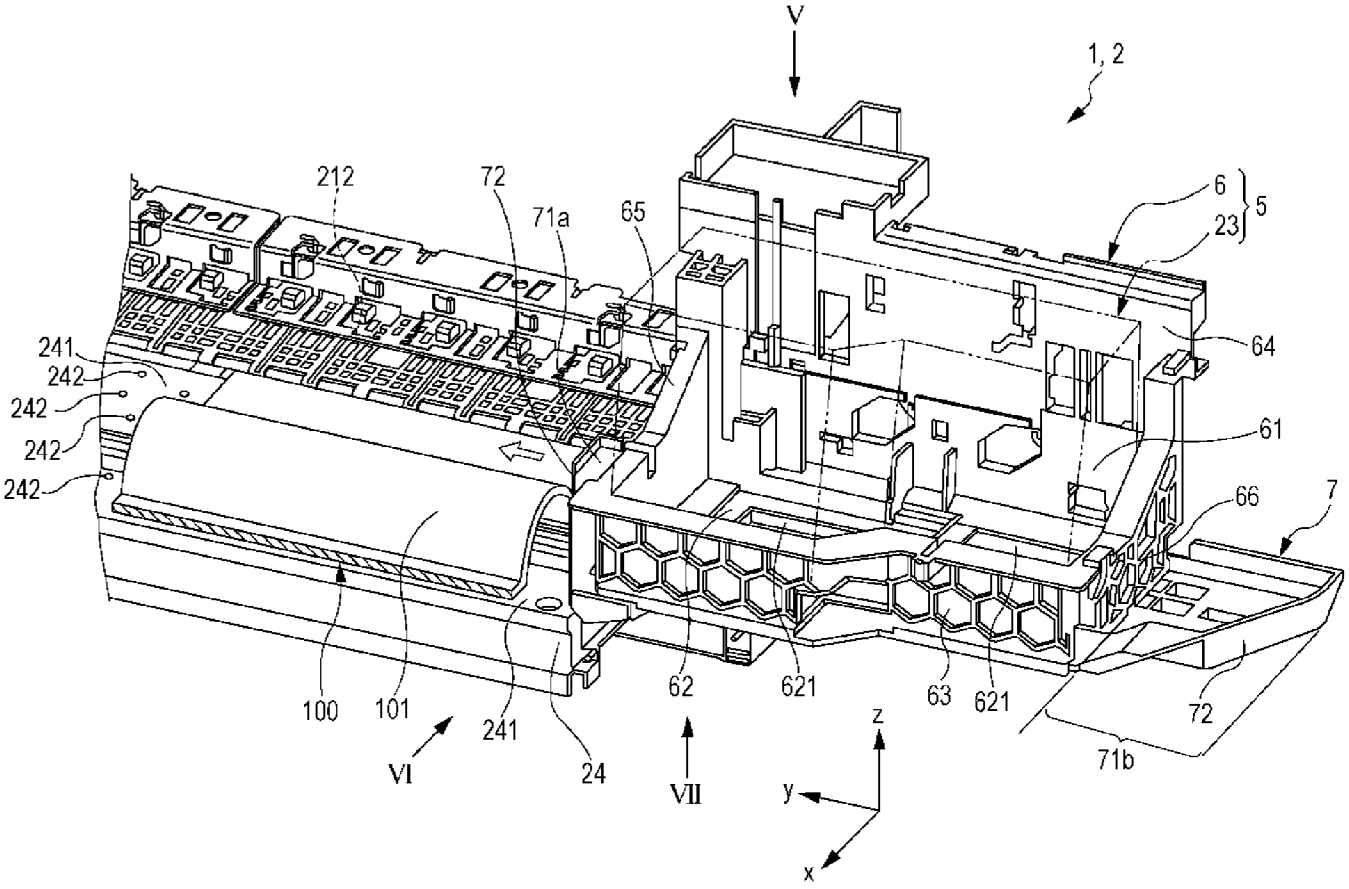
FIG. 3 is a perspective view illustrating the surrounding area of a head unit included in the printing apparatus illustrated in FIG. 1.
Figure 4:
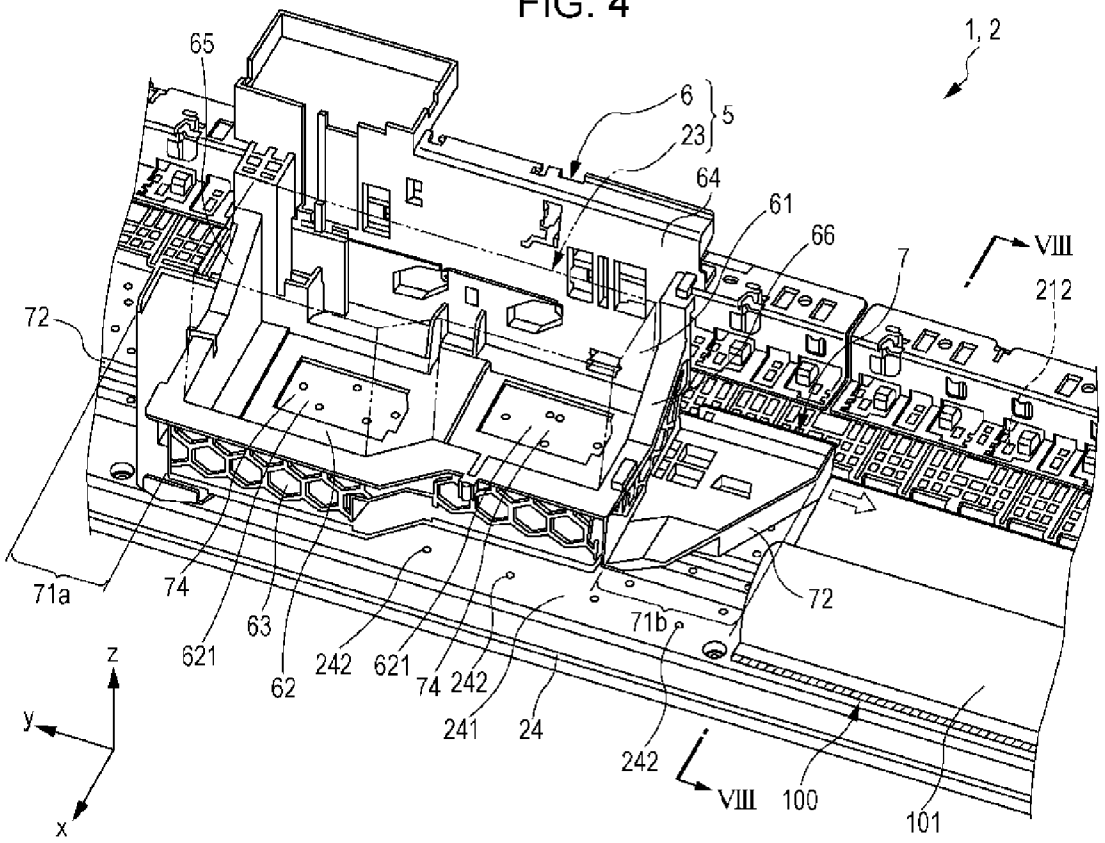
FIG. 4 is a perspective view illustrating the surrounding area of the head unit included in the printing apparatus illustrated in FIG. 1.
Figure 5:
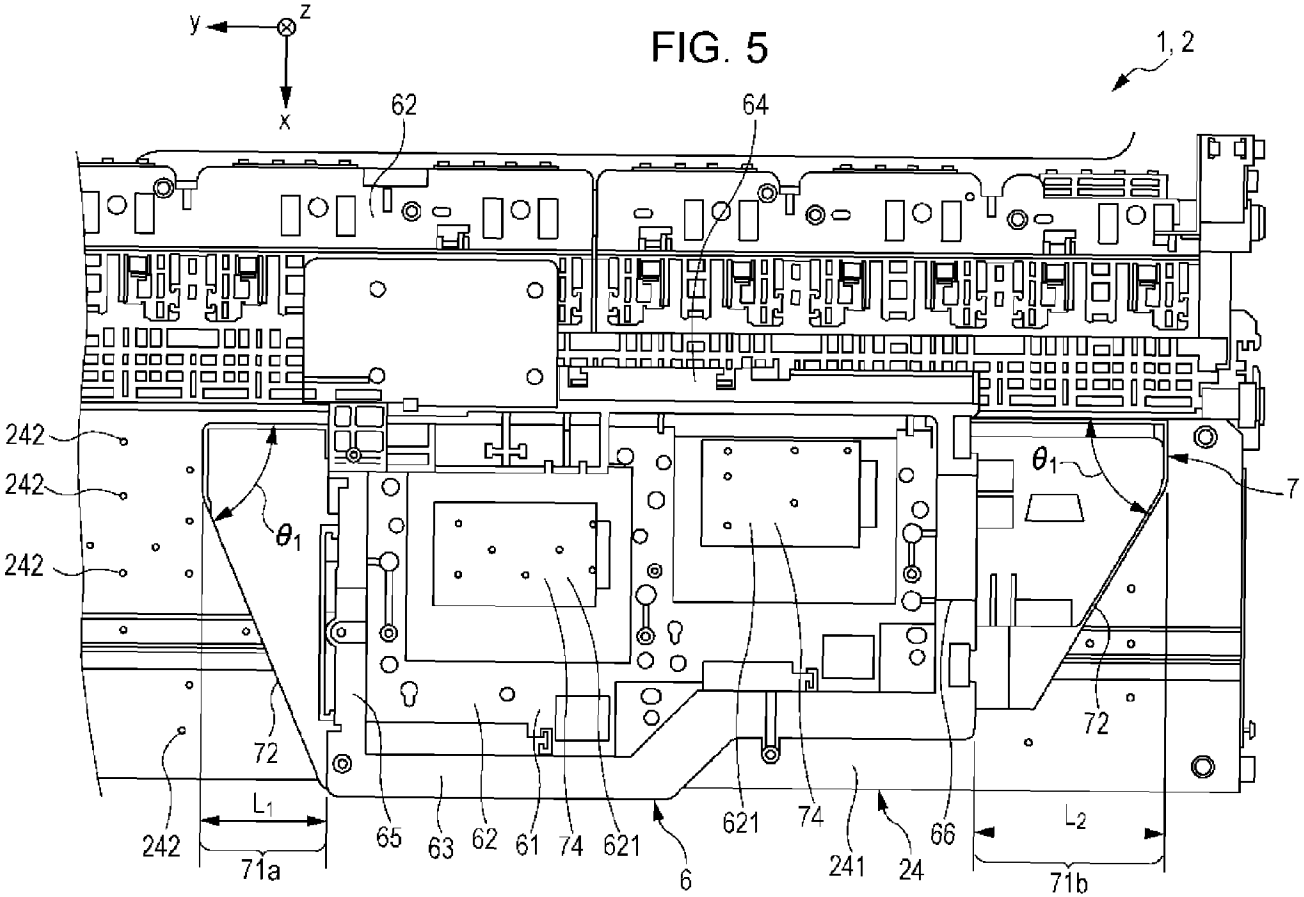
FIG. 5 is a view (plan view) viewed from the arrow V direction in FIG. 3.
Figure 6:
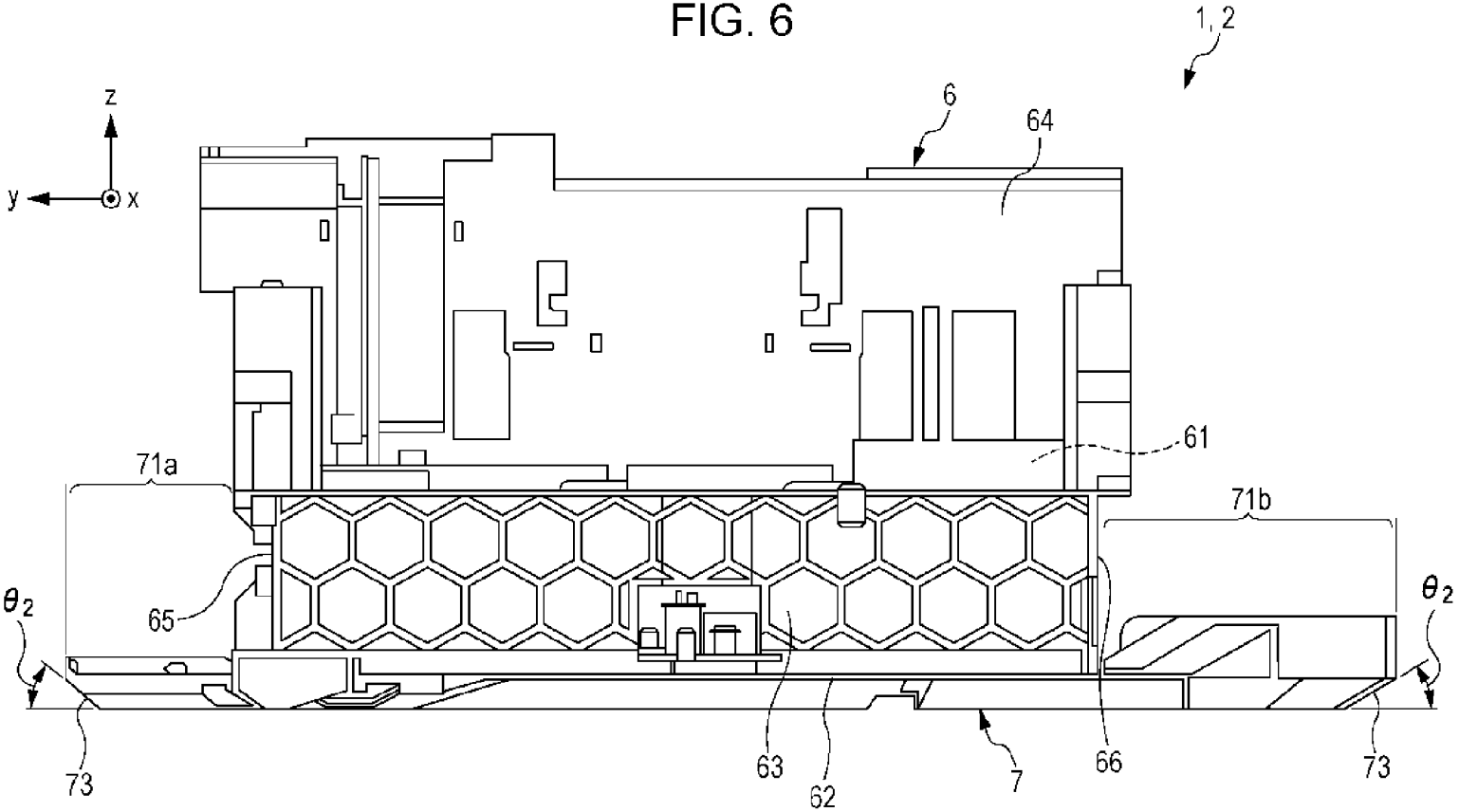
FIG. 6 is a view (front view) viewed from the arrow VI direction in FIG. 3.
Figure 7:
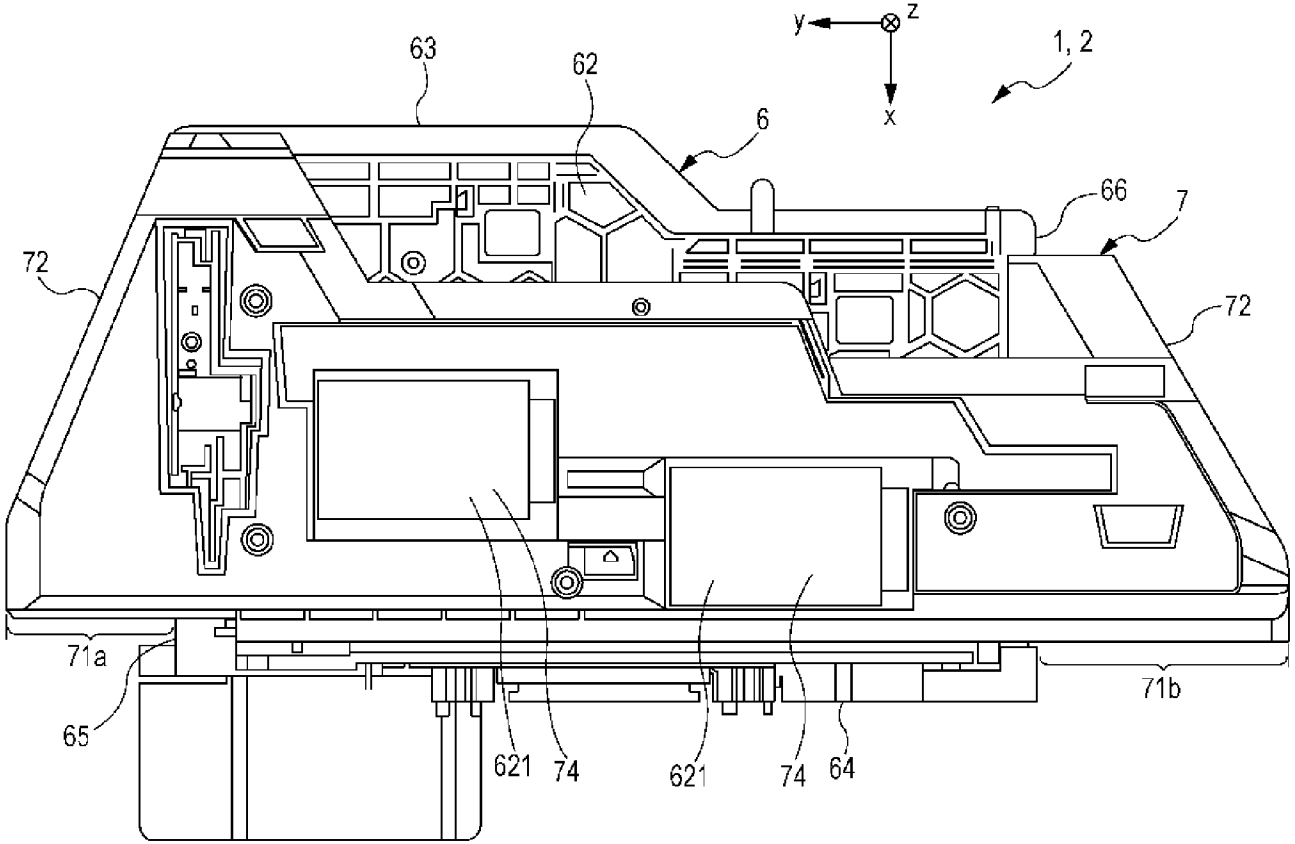
FIG. 7 is a view (bottom view) viewed from the arrow VII direction in FIG. 3.

FIG. 1 illustrates a perspective view of a first embodiment of a printing apparatus in the invention, FIG. 2 illustrates a cross-sectional view (schematic cross-sectional view) taken along line II-II in FIG. 1, FIGS. 3 and 4 respectively illustrate perspective views of the surrounding of a head unit included in the printing apparatus illustrated in FIG. 1, FIG. 5 illustrates a view (plan view) viewed from the arrow V direction in FIG. 3, FIG. 6 illustrates a view (front view) viewed from the arrow VI direction in FIG. 3, FIG. 7 illustrates a view (bottom view) viewed from the arrow VII direction in FIG. 3, and FIGS. 8A to 8D illustrate cross-sectional views (views illustrating a process in which a warpage of a recording medium is straightened) taken along lines VIIIA-VIIIA, VIIIB-VIIIB, VIIIC-VIIIC, and VIIID-VIIID in FIG. 4. Furthermore, hereinafter, for convenience of description, an x-axis, a y-axis and a z-axis are illustrated as three axes orthogonal to one another in FIGS. 1 to 8D (same in FIGS. 9 to 17).

The x-axis is an axis along one direction (width (depth) direction of the printing apparatus) in the horizontal directions, the y-axis is an axis along a direction (longitudinal direction of the printing apparatus) that is the horizontal direction and perpendicular to the x-axis, and the z-axis is an axis along a vertical direction (up-and-down direction). In addition, a tip side of each illustrated arrow denotes the "positive side (plus side)", and a base end side thereof denotes the "negative side (minus side)". In addition, an upper side in FIGS. 1 to 8D (same in FIGS. 9 to 11) is referred to as "up (upper part)", and a lower side is referred to as "down (lower part)".

As illustrated in FIG. 1, a printing apparatus 1 includes an apparatus main body 2, a leg section (stand) 3 and a curing unit 4. The printing apparatus 1 is an ink jet-type apparatus that imparts an ink onto a recording medium 100 to perform color printing. Hereinafter, the configuration of each component will be described.

First, the ink and the recording medium 100 will be described.

The ink employed in printing is a so-called "latex ink" and loaded in the printing apparatus 1 as an ink set (cartridge). The ink set includes a first ink and a second ink which have a predetermined composition, and satisfies either predetermined condition (A) or (B) described below.

The first ink contains a colorant, resin particles, a first humectant and a non-proton type polar solvent.

The second ink contains the colorant in an amount that exceeds the content of the colorant included in the first ink, the resin particles in an amount less than the content of the resin particles included in the first ink, a second humectant, and the non-proton type polar solvent.

Meanwhile, both the first ink and the second ink do not substantially contain alkyl-polyol having a boiling point of 280° C. or higher. Accordingly, it is possible to reduce the load during a drying process.

Here, the above-mentioned term "not substantially contain" denotes, for example, not to contain 1.0 mass % or more, preferably not to contain 0.5 mass % or more, more preferably not to contain 0.1 mass % or more, still more preferably not to contain 0.05 mass % or more, yet more preferably not to contain 0.01 mass % or more, and most preferably not to contain 0.001 mass % or more with respect to the total mass (100 mass %) of the ink.

Furthermore, it is preferable that the ink set be configured of the first ink and the second ink. However, an ink that is different from the above-mentioned inks may be further included, in addition to the first ink and the second ink. In addition to the first ink and the second ink, if an ink which is different from the aforementioned inks is further included, the further included ink may contain the alkyl-polyol having a boiling point of 280° C. or higher.

Hereinafter, an additive (component) that is included or may be included in each ink (ink composition) configuring the ink set will be described.

In the following, if the first ink and the second ink that configure the ink set, and an ink that is different from the above-mentioned inks are further included, the further included ink may be also collectively referred to as an "ink".

Furthermore, unless particularly stated, each component contained in the first ink and each component contained in the second ink are respectively and independently selected in terms of type, physical properties thereof, content, and the like. In addition, not only in a case where both the first ink and the second ink that are included in one ink set consist of one type alone, but also in a case where the first ink is present in plural types and in a case where the second ink is present in plural types, similarly as above, type, physical properties thereof, content, and the like of each component included in the respective inks are respectively and independently selected.

Moreover, in a case where the first ink included in one ink set is present in plural types, the "content of the first ink" denotes an average of the contents in the respective first inks. Furthermore, the same denoting can be applied to a case where the second ink is present in the plurality of types.

Humectant

Both the first ink and the second ink included in the ink set contain the humectant. Here, the "first humectant" in the specification denotes the humectant included in the first ink, and the "second humectant" in the specification denotes the humectant included in the second ink. The first humectant and the second humectant are correlative to each other in that the aforementioned two humectants satisfy either condition of (A) or (B) described below.

Hereinafter, each condition in (A) and (B) will be described.

First, the condition in (A) will be described. In (A), the first humectant is, (a1) a 1,2-alkanediol and non 1,2-alkanediol solvent, or (a2) a non 1,2-alkanediol solvent. In addition, the boiling point of the non 1,2-alkanediol solvent between the first humectants is within a range from 200° C. to 260° C. That is, regardless of whether to include the 1,2-alkanediol solvent or not, the first humectant essentially includes the non 1,2-alkanediol solvent having a predetermined boiling point.

If the boiling point of the first humectant is 160° C. or higher, the first humectant becomes excellent in the intermittent printing property. Meanwhile, if the boiling point of the first humectant is 260° C. or lower, since glycerin and the like are not added thereto, the quick-drying property becomes favorable such that a recorded matter is excellent in friction resistance.

The non 1,2-alkanediol solvent which is the first humectant is not particularly limited, as long as the boiling point is within a range from 200° C. to 260° C. or lower. However, for example, glycol ethers and 1,α-alkanediol (however, excluding α=2) can be exemplified.

The glycol ethers are not limited to the following. However, for example, polyalkylene glycols such as diethylene glycol, dipropylene glycol, and dibutylene glycol can be exemplified. The 1,α-alkanediol (however, excluding α=2) is not limited to the following. However, for example, 1,4-butanediol, 1,5-pentanediol, 1,6-hexanediol, and 1,7-heptanediol can be exemplified. As alkylene glycol monoether included in the polyalkylene glycols; ethylene glycol monomethyl ether, ethylene glycol monoethyl ether, ethylene glycol monoisopropyl ether, ethylene glycol monobutyl ether, ethylene glycol monohexyl ether, ethylene glycol monophenyl ether, diethylene glycol monomethyl ether, diethylene glycol monoethyl ether, diethylene glycol monobutyl ether, diethylene glycol dimethyl ether, diethylene glycol diethyl ether, triethylene glycol monomethyl ether, triethylene glycol monoethyl ether, triethylene glycol monobutyl ether, tetraethylene glycol monomethyl ether, tetraethylene glycol monoethyl ether, propylene glycol monomethyl ether, propylene glycol monoethyl ether, dipropylene glycol monomethyl ether, and dipropylene glycol monoethyl ether can be exemplified. As alkylene glycol diether included in the polyalkylene glycols; ethylene glycol dimethyl ether, ethylene glycol diethyl ether, ethylene glycol dibutyl ether, diethylene glycol dimethyl ether, diethylene glycol diethyl ether, diethylene glycol dibutyl ether, triethylene glycol dimethyl ether, triethylene glycol diethyl ether, triethylene glycol dibutyl ether, tetraethylene glycol dimethyl ether, tetraethylene glycol diethyl ether, tetraethylene glycol dibutyl ether, propylene glycol dimethyl ether, propylene glycol diethyl ether, dipropylene glycol dimethyl ether, and dipropylene glycol diethyl ether can be exemplified. It is preferable to use the polyalkylene glycols among the glycol ethers to obtain an excellent moisture retaining property therein.

In order that the appropriate moisture retaining property can be imparted thereto, it is preferable that one or more types selected from the glycol ethers and 1,α-alkanediol (however, excluding α=2) be used among thereabove.

In a case where the first humectant is (a1) the 1,2-alkanediol and non 1,2-alkanediol solvent, in the first ink, it is preferable that the mass ratio of the content of the total first humectant and the content of the below-described non-proton type polar solvent ("content of the total first humectant": "content of the non-proton type polar solvent") be 0.6 to 2.6. If the mass ratio is within the above range, the first ink becomes excellent in adhesion.

In addition, in (A) described above, the condition in which the boiling point of the first humectant exceeds the boiling point of the second humectant is also satisfied. Furthermore, the "boiling point of the first humectant" in the specification denotes an average of the boiling points of two or more types of solvents in a case where the first humectant is configured of two types or more, and the same denoting can be applied to the "boiling point of the second humectant".

On the assumption that the conditions are satisfied, the second humectant is, (a3) the 1,2-alkanediol and non 1,2-alkanediol solvent, or (a4) the non 1,2-alkanediol solvent. In addition, it is preferable that the boiling point of the non 1,2-alkanediol solvent between the second humectants be within a range from 160° C. to 240° C. That is, the second humectant may be the 1,2-alkanediol. However, regardless of whether to include the 1,2-alkanediol solvent or not, it is preferable that the second humectant include the non 1,2-alkanediol solvent having a predetermined boiling point.

If the boiling point of the second humectant is 160° C. or higher, the second humectant becomes excellent in the intermittent printing property. Meanwhile, if the boiling point of the second humectant is 240° C. or lower, a drying load can be effectively reduced.

The non 1,2-alkanediol solvent which is the second humectant is not particularly limited, as long as the boiling point is within a range from 160° C. to 240° C., and lower than that of the first humectant. However, the glycol ethers can be preferably exemplified for having excellent drying property.

Next, the condition in (B) will be described. Both the first humectant and the second humectant are the dipropylene glycol. In addition, the content of the dipropylene glycol included in the first ink exceeds the content of the dipropylene glycol included in the second ink.

It is preferable that the content of the dipropylene glycol included in the first ink be within a range from 3 mass % to 30 mass % with respect to the total mass (100 mass %) of the first ink, and it is more preferable to be within a range from 5 mass % to 15 mass %. Meanwhile, it is preferable that the content of the dipropylene glycol included in the second ink be within a range from 3 mass % to 30 mass %, and it is more preferable to be within a range from 5 mass % to 15 mass %. If each content of the dipropylene glycol included in the first ink and the second ink is within the above range, the drying load can be effectively reduced.

Moreover, if the ink set further includes an ink which is different from the first ink and the second ink, the further included ink may contain the above-described humectants.

Colorant

The first ink and the second ink included in the ink set contain the colorant. The colorant is selected from pigments and dyes.

1. Pigment

The pigment of the colorant has a property of which is not only insoluble or hardly soluble in water but also difficult to be discolored with respect to light, gas and the like. Accordingly, a recorded matter recorded by the ink employing the pigment becomes favorable in water resistance, gas resistance, light resistance and preservation stability.

Either an inorganic pigment or an organic pigment can be used for the pigment. Since the color developing property thereof is favorable and precipitation does not easily occur when dispersed due to the small specific gravity, at least either carbon black belonging to the inorganic pigment or the organic pigment is preferable as the pigment.

The inorganic pigment is not particularly limited. However, for example, carbon black, iron oxide and titanium oxide can be exemplified.

The carbon black is not particularly limited. However, for example, furnace black, lamp black, acetylene black and channel black (C.I. Pigment Black 7) can be exemplified. In addition, as the commercial products for the carbon black, for example; No. 2300, 900, MCF 88, No. 20B, No. 33, No. 40, No. 45, No. 52, MA7, MA8, MA100, and No. 2200B (hereinbefore, all product names, manufactured by Mitsubishi Chemical Corporation); Color Black FW1, FW2, FW2V, FW18, FW200, 5150, 5160, 5170, Printex 35, U, V, 140U, Special Black 6, 5, 4A, 4, and 250 (hereinbefore, all product names, manufactured by Degussa AG); Conductex SC, Raven 1255, 5750, 5250, 5000, 3500, 1255, and 700 (hereinbefore, all product names, manufactured by Columbian Carbon Japan Ltd.); and Regal 400R, 330R, 660R, Mogul L, Monarch 700, 800, 880, 900, 1000, 1100, 1300, 1400, and Elftex 12 (hereinbefore, all product names, manufactured by Cabot Corporation) can be exemplified.

The organic pigment is not particularly limited. However, for example, quinacridone-based pigment, quinacridone-quinone-based pigment, dioxazine-based pigment, phthalocyanine-based pigment, anthrapyrimidine-based pigment, anthanthrone-based pigment, indanthrone-based pigment, flavanthrone-based pigment, perylene-based pigment, diketopyrrolopyrrole-based pigment, perinone-based pigment, quinophthalone-based pigment, anthraquinone-based pigment, thioindigo-based pigment, benzimidazolone-based pigment, isoindolinone-based pigment, azomethine-based pigment and azo-based pigment can be exemplified. As the specific examples for the organic pigment, the following can be exemplified.

As the pigment to be used for a cyan ink, C.I. Pigment Blue 1, 2, 3, 15, 15:1, 15:2, 15:3, 15:4, 15:6, 15:34, 16, 18, 22, 60, 65, and 66; and C.I. Vat Blue 4, and 60 can be exemplified.

As the pigment to be used for a magenta ink, C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, (Ca), 48 (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, 245, 254, and 264; and C.I. Pigment Violet 19, 23, 32, 33, 36, 38, 43, and 50 can be exemplified.

As the pigment to be used for a yellow ink, C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, and 213 can be exemplified.

Furthermore, as the pigment to be employed for other colors of the inks such as green ink or orange ink in addition to the above-mentioned colors, known materials in the related art can be exemplified.

The pigment may be employed in one type alone, or may be employed in a combination of two types or more.

2. Dye

The dye of the colorants is not limited to the following. However, for example, acid dye, direct dye, reactive dye and basic dye can be exemplified. As the specific examples for the dyes, C.I. Acid Yellow 17, 23, 42, 44, 79, and 142; C.I. Acid Red 52, 80, 82, 249, 254, and 289; C.I. Acid Blue 9, 45, and 249; C.I. Acid Black 1, 2, 24, and 94; C.I. Food Black 1, and 2; C.I. Direct Yellow 1, 12, 24, 33, 50, 55, 58, 86, 132, 142, 144, and 173; C.I. Direct Red 1, 4, 9, 80, 81, 225, and 227; C.I. Direct Blue 1, 2, 15, 71, 86, 87, 98, 165, 199, and 202; C.I. Direct Black 19, 38, 51, 71, 154, 168, 171, and 195; C.I. Reactive Red 14, 32, 55, 79, and 249; and C.I. Reactive Black 3, 4, and 35 can be exemplified.

The dye may be employed in one type alone, or may be employed in a combination of two types or more.

The content of the colorant included in the second ink is greater than the content of the colorant included in the first ink. The first ink and the second ink can be respectively referred to as the light ink and the dark ink from a viewpoint of an amount of the colorant.

It is preferable that the content of the colorant included in the first ink be 1 mass % to 7 mass % with respect to the total mass (100 mass %) of the first ink. In addition, it is preferable that the content of the colorant included in the second ink be 0.1 mass % to 2 mass % with respect to the total mass (100 mass %) of the second ink.

Moreover, if the ink set further includes an ink which is different from the first ink and the second ink, the further included ink may contain the above-described colorant.

Resin Particle

The first ink and the second ink included in the ink set contain the resin particles. Since the first ink and the second ink contain the resin particles, a recorded matter is excellent in friction resistance.

In addition, the content of the resin particles included in the second ink is less than the content of the resin particles included in the first ink. Accordingly, it is possible to make the viscosity of each ink configuring the ink set uniform. The content of each of the resin particles included in the first ink and the second ink will be described below.

The resin particle is not limited to the following. However, for example, a wax such as a binder resin, a paraffin wax and polyolefin wax can be exemplified.

1. Binder Resin

When the recording medium 100 is heated for ink jet recording, the binder resin forms resin coating to cause the ink to be sufficiently fixed onto the recording medium 100, thereby exhibiting effectiveness to make a recorded matter favorable in friction resistance. Therefore, it is preferable that the binder resin be a thermoplastic resin. According to the above-described effect, a recorded matter recorded with the ink containing the binder resin is more excellent in friction resistance on the recording medium 100 which is non-ink absorbable and low ink absorbable.

In addition, the binder resin is contained in the ink in an emulsion state. If the binder resin is contained in the ink in the emulsion state, the viscosity of the ink is easily adjusted within an appropriate range in an ink jet recording method, while being excellent in preservation stability and ejection stability of the ink.

Furthermore, the "ejection stability" in the specification denotes a property with which a nozzle is clog-free such that stable ink droplets are ejected from the nozzle all the time.

The binder resin is not limited to the following. However, for example; a homopolymer or a copolymer of (meth)acrylic acid, (meth)acrylic acid ester, acrylonitrile, cyanoacrylate, acrylamide, olefin, styrene, vinyl acetate, vinyl chloride, vinyl alcohol, vinyl ethers, vinyl pyrrolidone, vinyl pyridine, vinyl carbazole, vinyl imidazole, and vinylidene chloride; a fluorine resin; and a natural resin can be exemplified. Among the above, at least either a (meth)acrylic resin or a styrene-(meth)acrylic acid copolymer resin is preferable, at least either an acrylic resin or a styrene-acrylic acid copolymer resin is more preferable, and a styrene-acrylic acid copolymer resin is still more preferable. Furthermore, the copolymer may be any one of a random copolymer, a block copolymer, an alternating copolymer and a graft copolymer.

Furthermore, in the specification, "(meth) acrylic" denotes at least either acryl or methacryl corresponding thereto.

As the binder resin, a material which can be obtained by known materials and manufacturing methods may be employed, or commercial products may be employed. The commercial products are not limited to the following. However, for example; Microgel E-1002, and Microgel E-5002 (hereinbefore, product names, manufactured by Nippon Paint Co., Ltd.); Bon Coat 4001, and Bon Coat 5454 (hereinbefore, product names, manufactured by DIC Corporation); SAE 1014 (product name, manufactured by Zeon Corporation); Saivinol SK-200 (product name, manufactured by Saiden Chemical Industry Co., Ltd.); and Joncryl 7100, Joncryl 390, Joncryl 711, Joncryl 511, Joncryl 7001, Joncryl 632, Joncryl 741, Joncryl 450, Joncryl 840, Joncryl 74J, Joncryl HRC-1645J, Joncryl 734, Joncryl 852, Joncryl 7600, Joncryl 775, Joncryl 537J, Joncryl 1535, Joncryl PDX-7630A, Joncryl 352J, Joncryl 352D, Joncryl PDX-7145, Joncryl 538J, Joncryl 7640, Joncryl 7641, Joncryl 631, Joncryl 790, Joncryl 780, and Joncryl 7610 (hereinbefore, product names, manufactured by BASF) can be exemplified.

The binder resin is not particularly limited. However, the binder resin can be obtained, for example, by the preparation methods described below. Otherwise, a plurality of methods may be combined if necessary. As the preparation method; a method in which a polymerization catalyst (polymerization initiator) and dispersant are mixed in a monomer with components configuring a desired resin for polymerization (emulsion polymerization); a method in which a resin having a hydrophilic moiety is dissolved in a water-soluble organic solvent to obtain a solution that is to be mixed into water, and then, the water-soluble organic solvent is eliminated by distillation or the like; and a method in which a resin is dissolved in a water-insoluble organic solvent to obtain a solution that is to be mixed with the dispersant in an aqueous solution.

The dispersant that can be used for dispersing the binder resin in an emulsion state is not particularly limited. However, for example; an anionic surfactant such as dodecyl benzene sulfonic acid sodium salt, sodium lauryl phosphate salt, and polyoxyethylene alkyl ether sulfate ammonium salt; and a nonionic surfactant such as polyoxyethylene alkyl ethers, polyoxyethylene alkyl esters, polyoxyethylene sorbitan fatty acid esters, and polyoxyethylene alkyl phenyl ether can be exemplified. The dispersants may be employed in one type alone, or may be employed in combination of two types or more.

It is preferable that the average particle diameter of the binder resin be within a range from 5 nm to 400 nm, and it is more preferable to be within a range from 20 nm to 300 nm, in order to have favorable preservation stability and ejection stability of the ink.

Here, the average particle diameter in the specification indicates the measured value by a dynamic light scattering method.

It is preferable that the content (converted into solid content) of the binder resin which may be included in each ink be within a range from 0.5 mass % to 5 mass % with respect to the total mass (100 mass %) of the ink, and it is more preferable to be within a range from 0.5 mass % to 1.5 mass %. If the content is within the above range, the ink becomes more excellent in friction resistance.

2. Paraffin Wax

If the ink in the embodiment contains paraffin wax, slip performance is imparted to a recorded matter. Accordingly, the ink is more excellent in friction resistance. Furthermore, since the paraffin wax is water-repellent, the recorded matter can be favorable to water resistance.

The "paraffin wax" in the specification denotes a so-called petroleum-based wax, and denotes a hydrocarbon mixture with the approximate weight-average molecular weight of 300 to 500 including a small amount of isoparaffin, while the main component thereof is linear paraffin hydrocarbon (normal paraffin) with an approximate carbon number of 20 to 30.

If the ink in the embodiment contains the paraffin wax in an emulsion state, viscosity of the ink is easily adjusted within an appropriate range in the ink jet recording method, while being able to achieve excellent preservation stability and ejection stability of the ink.

It is preferable that the melting point of the paraffin wax be 110° C. or lower in order to further secure the coating of a recorded matter and further make the recorded matter be favorable in friction resistance. Meanwhile, it is preferable that the lower limit of the melting point of the paraffin wax be 60° C. or higher in order to prevent the dried recorded surface from being sticky. Furthermore, it is more preferable that the melting point be 70° C. to 95° C. in order to cause the ink to be more favorable in ejection stability.

It is preferable that the average particle diameter of the paraffin wax be within a range from 5 nm to 400 nm, and it is more preferable to be within a range from 50 nm to 200 nm in order to achieve still more favorable preservation stability and ejection stability of the ink in a stable emulsion state. As the paraffin wax, commercial products may be utilized in its integrity. The commercial products are not limited to the following. However, for example, AQUACER 537 and AQUACER 539 (hereinbefore, product names, manufactured by BYK-Chemie GmbH) can be exemplified.

It is preferable that the content (converted into solid content) of the paraffin wax which may be included in each ink be within a range from 0 mass % to 1.5 mass % with respect to the total mass (100 mass %) of the ink, and it is more preferable to be within a range from 0.25 mass % to 0.75 mass %.

3. Polyolefin Wax

If the ink in the embodiment contains polyolefin wax, it is possible to obtain a recorded matter that is more excellent in friction resistance of a recorded matter. The polyolefin wax is not limited to the following, for example, polyethylene wax and polypropylene wax can be exemplified, and polypropylene is preferable therebetween.

As an exemplification of a manufacturing method of the polyethylene wax, the polyethylene wax is produced by polymerizing ethylene to be manufactured or causing the polyethylene for general molding to have a low molecular weight through thermal decomposition so as to be manufactured. Then, a carboxyl group and a hydroxyl group are added to the oxidized polyethylene wax to be further emulsified using a surfactant. Thereafter, polyethylene wax can be obtained in a form of an aqueous emulsion having excellent stability.

As the polyolefin wax, commercial products may be utilized in its integrity. The commercial products of the polyethylene wax thereamong are not limited to the following, for example, Nopcoat PEM 17 (product name, manufactured by Sannopco Limited), Chemipearl W4005 (product name, manufactured by Mitsui Chemicals Inc.), and AQUACER 515 and AQUACER 593 (hereinbefore, product names, manufactured by BYK-Chemie GmbH) can be exemplified.

It is preferable that the average particle diameter of the polyolefin wax be within a range from 5 nm to 400 nm, and it is more preferable to be within a range from 50 nm to 200 nm, in order to achieve still more favorable preservation stability and ejection stability of the ink.

It is preferable that the content (converted into solid content) of the polyolefin wax which may be included in each ink be within a range from 0 mass % to 1.5 mass % with respect to the total mass (100 mass %) of the ink, and it is more preferable to be within a range from 0.25 mass % to 0.75 mass %.

Since a recorded matter becomes more excellent in friction resistance, it is preferable that the resin particle be at least either the polyolefin wax or paraffin wax among the materials hitherto described.

Furthermore, each ink may contain other waxes as the resin particles in addition to the polyolefin wax and the paraffin wax. The wax has a function to impart slip performance onto a front surface of a formed recorded matter to be more favorable in friction resistance. It is preferable that the wax be contained in the ink in an emulsion state. If the wax is present in the ink in the emulsion state, viscosity of the ink is easily adjusted within an appropriate range in the ink jet recording method, while being more excellent in preservation stability and ejection stability of the ink.

Moreover, if the ink set further includes an ink which is different from the first ink and the second ink, the further included ink may contain the above-described resin particle.

Non-Proton Type Polar Solvent

The first ink and the second ink included in the ink set contain a non-proton type polar solvent. The first ink and the second ink contain the non-proton type polar solvent to dissolve the above-mentioned resin particles included in the inks, thereby effectively preventing the clogging in the nozzle when performing the ink jet recording.

The non-proton type polar solvents contained in the first ink and the second ink may have the same component as each other.

The non-proton type polar solvent is not limited to following. However, it is preferable to include one type or more selected from a group consisting of pyrrolidones, lactones, sulfoxides, imidazolidinones, sulfolanes, urea derivatives, dialkyl amides, cyclic ethers and amide ethers.

As the specific examples for the pyrrolidones, 2-pyrrolidone, N-methyl-2-pyrrolidone, and N-ethyl-2-pyrrolidone can be exemplified. As the specific examples for the lactones, γ-butyrolactone, γ-valerolactone, and ϵ-caprolactone can be exemplified. As the specific examples for the sulfoxides, dimethyl sulfoxide, and tetramethylene sulfoxide can be exemplified. As the specific example for the imidazolidinones, 1,3-dimethyl-2-imidazolidinone can be exemplified. As the specific examples for the sulfolanes, sulfolane, and dimethyl sulfolane can be exemplified. As the specific examples for the urea derivatives, dimethyl urea, and 1,1,3,3-tetramethyl urea can be exemplified. As the specific examples for the dialkyl amides, dimethylformamide, and dimethylacetamide can be exemplified. As the specific examples for the cyclic ethers, 1,4-dioxane, and tetrahydrofuran can be exemplified.

In addition, a solvent represented by following chemical formula 1 corresponds to the amide ethers.

(1)

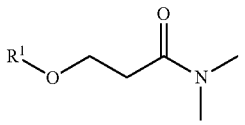

In chemical formula 1, it is suitable for $R^1$ to be an alkyl group with the carbon number of 1 to 4. An "alkyl group with the carbon number of 1 to 4" may be a linear or branched alkyl group such that it is possible to be, for example, a methyl group, an ethyl group, an n-propyl group, an iso-propyl group, an n-butyl group, an iso-butyl group, a sec-butyl group and a tert-butyl group. A solvent that is represented by chemical formula 1, in which $R^1$ is the alkyl group with the carbon number of 1 to 4, can impart proper pseudoplasticity to an ink composition. Accordingly, favorable ejection stability of the ink can be secured. In addition, since the solvent, represented by chemical formula 1 in which $R^1$ is the alkyl group with the carbon number of 1 to 4, is particularly strong in a resin dissolving action, thereby being preferable.

It is preferable that HLB value of the solvent represented by chemical formula 1 be within a range from 10.5 or more and 20.0 or less, and it is more preferable to be within a range from 12.0 or more and 18.5 or less. It is more suitable for the HLB value of the solvent represented by chemical formula 1 to be within the above range, in terms of being able to impart proper pseudoplasticity to the ink, and interacting with the resin component.

Furthermore, the HLB value of the solvent represented by chemical formula 1 is a value calculated by the following equation from the ratio of a non-polar value (I) and an organic value (O) (hereinafter, may be simply referred to as "I/O value") in an organic conceptual diagram. HLB value=(non-polar value (I)/organic value (O))×10

Specifically, the I/O value can be calculated based on each literature of "SYSTEMATIC ORGANIC QUALITATIVE ANALYSIS, MIXTURE part" (written by Atsushi FUJITA, Kazamashobo, 1974), "DYEING THEORETICAL CHEMISTRY" (written by Nobuhiko KUROKI, Makishoten, 1966), and "ORGANIC COMPOUND SEPARATION METHOD" (Hiroo INOUE, Shokabo, 1990).

In order to have an excellent fixation property with respect to the recording medium 100, it is preferable that one type or more be selected from a group consisting of pyrrolidones, lactones, sulfoxides, and amide ethers among the above-mentioned non-proton type polar solvents.

It is preferable that the boiling point of the non-proton type polar solvent be within a range from 200° C. to 260° C.

A specific example of the non-proton type polar solvent is not limited to the following. However, 2-pyrrolidinone is suitably employed.

The non-proton type polar solvents respectively included in the first ink and the second ink may be employed in one type alone, or may be a combination of two types or more to be employed.

It is preferable that the content of the non-proton type polar solvent respectively included in the first ink and the second ink be within a range from 3 mass % to 30 mass % with respect to the total mass (100 mass %) of the ink, and it is more preferable to be within a range from 8 mass % to 20 mass %.

Moreover, if the ink set further includes an ink which is different from the first ink and the second ink, the further included ink may contain the above-described non-proton type polar solvent.

Surfactant

Each ink included in the ink set may contain the surfactant. Other surfactants are not limited to the following. However, for example, the nonionic surfactant can be exemplified. The nonionic surfactant acts to uniformly spread the ink on the recording medium 100. Therefore, if the ink jet recording is performed employing the ink including the nonionic surfactant, a high-definition image with little bleeding can be obtained. The nonionic surfactants are not limited to the following. However, for example; acetylene glycol-based surfactant; silicon-based surfactant; and polyoxyethylene alkyl ether-based, polyoxypropylene alkyl ether-based, polycyclic phenyl ether-based, sorbitan derivatives and fluorine-based surfactants can be exemplified.

The surfactant may be employed in one type alone, or may be a combination of two types or more to be employed.

The content of the surfactant which may be included in each ink is within a range from 1.5 mass % or less with respect to the total mass (100 mass %) of the ink.

Water

Each ink included in the ink set may contain water. Particularly, if the ink is a water-based ink, the water is a main medium in the ink so as to be a component evaporating and dispersing when the recording medium 100 is heated during the ink jet recording.

As the water, for example, water from which ion impurities are eliminated to the fullest such as pure water such as ion-exchanged water, ultrafiltration water, reverse osmosis water, distilled water, and ultrapure water can be exemplified. In addition, if water which is sterilized by irradiating ultra violet rays, adding hydrogen peroxide, or the like is employed, it is possible to prevent bacteria and fungi from occurring when preserving a pigment dispersing liquid and the ink employing the pigment dispersing liquid for a long period.

Other Components

Each ink included in the ink set may further contain an organic solvent other than the above-mentioned solvents, a pH regulator, an antiseptic, a fungicide, a rust inhibitor, a chelating agent, and the like in addition to the components described above.

The recording medium 100, to which the ink is imparted, has flexibility and is loaded to the printing apparatus 1 in a roll-shaped wound state. The recording medium 100 is suitable for the ink jet recording which employs not only an ink absorbent recording medium but also non-ink-absorbent and low-ink-absorbent recording media.

The ink absorbent recording medium 100 is not limited to the following. However, for example, paper for exclusive use for the ink jet recording such as plain paper, fine quality paper, and glossy paper can be exemplified. As the low-ink-absorbent recording medium 100, actual printing paper such as art paper, coated paper and matte paper can be exemplified. The non-ink-absorbent recording medium 100 is not limited to the following. However, for example; materials such as a plastic film, which is not surface-treated for the ink jet printing (that is, an ink absorbent layer is not formed thereon); and materials in which a base material such as paper is coated with plastic or is adhered with a plastic film can be exemplified. The plastic is not particularly limited. However, for example, polyvinyl chloride, polyethylene terephthalate, polycarbonate, polystyrene, polyurethane, polyethylene and polypropylene can be exemplified.

Next, the printing apparatus 1 will be described. As described in the above, the printing apparatus 1 includes the apparatus main body 2, the leg section (stand) 3 and the curing unit 4 (see FIG. 1).

As illustrated in FIG. 3, the apparatus main body 2 has a transportation unit 21, a head unit (head assembly) 5, a warpage straightening member (warpage straightening unit) 7, a movement unit 22, a platen 24, a preheater 25, a dry heater 26, a blower fan 27, a suction fan 28 and a casing (housing) 29.

The casing 29 is a boxlike member collectively accommodating the transportation unit 21, the head unit 5, the warpage straightening member 7, the movement unit 22, the platen 24, the preheater 25, the dry heater 26, the blower fan 27 and the suction fan 28. In addition, the outer shape of the casing 29 (apparatus main body 2) is long-shaped along a y-axis direction.

The transportation unit 21 has rollers 211 and 212 which are arranged above and below so as to transport the recording medium 100. One roller between the rollers 211 and 212 is a driving roller connected to a motor via a speed reduction mechanism of a gear or the like, and the other roller is a driven roller. The driving roller rotates in a state where the recording medium 100 is clamped between the driving roller and the driven roller, thereby transporting, which means, being capable of sending out the recording medium 100 in concurrence with the driven roller. Hereinafter, a direction of transporting the recording medium 100 is referred to as a "transportation direction".

The preheater 25 heats the recording medium 100 in advance before printing is performed on the recording medium 100. The preheater 25 has a housing 252 having an abutting surface 251 on which a rear surface of the recording medium 100 abuts and a heating unit 253 accommodated inside the housing 252.

The abutting surface 251 is configured to form a curved surface which is curved in an arch shape. The recording medium 100 abuts on the abutting surface 251 during transportation by the transportation unit 21. At this moment, heat from the heating unit 253 is transferred to the recording medium 100 via the recording medium 100. Accordingly, it is possible to heat the abutting surface 251. Furthermore, it is preferable that the surface temperature of the recording medium 100 be of, for example, plus 5° C. or more with respect to the surface temperature of the recording medium 100 on the platen 24 when heating the preheater.

In addition, it is preferable that the curvature of the abutting surface 251 be gradually reduced toward a downstream side in the transportation direction, that is, the positive direction of the x-axis.

In addition, a configuration material of the housing 252 is not particularly limited. However, for example, aluminum, aluminum alloy or stainless steel can be employed.

The heating unit 253 generates heat by electrification, and is configured of, for example, a metal material having a relatively high electrical resistance such as a nichrome wire and the like.

The platen 24 is arranged at the downstream side in the transportation direction with respect to the preheater 25. The platen 24 is configured of a plate member so as to support the recording medium 100 from the lower side thereof when the ink is imparted to the recording medium 100. The platen 24 can be configured of, for example, the same material as the configuration material of the housing 252.

In addition, as illustrated in FIGS. 3 to 5, in the platen 24, numerous opening sections 242 that are open in an upper surface 241 are formed. The opening sections 242 are arranged along the surface direction of the platen 24.

Then, the suction fan 28 is arranged at the lower part of the platen 24. If the suction fan 28 is operated, that is, rotated, it is possible to suck the recording medium 100 on the platen 24 via each opening section 242 of the platen 24. Accordingly, the posture of the recording medium 100 can be stabilized when imparting the ink. Therefore, the ink is reliably imparted to the desired position on the recording medium 100.

Furthermore, the suction fan 28 is not particularly limited. However, for example, various kinds of fans such as a multi-blade fan (sirocco fan) and the like can be employed.

The head unit 5 is an assembly having a liquid droplet ejection head 23 and a carriage 6 to be assembled therewith.

The liquid droplet ejection head 23 is arranged at the upper part of the platen 24. The liquid droplet ejection head 23 has numerous nozzle ports (not illustrated) that are open toward the lower part. Then, the liquid droplet ejection head 23 can eject the ink as a liquid droplet from each nozzle port onto the recording medium 100 which is transported by the operation of the transportation unit 21.

In addition, each nozzle port of the liquid droplet ejection head 23 respectively communicates with the ink set (cartridge) via a tube 231. Accordingly, the ink can be supplied to each nozzle port.

The carriage 6 has an accommodation section 61 accommodating the liquid droplet ejection head 23. The liquid droplet ejection head 23 can be supported by accommodating the liquid droplet ejection head 23 in the accommodation section 61. The accommodation section 61 is configured to have a bottom plate 62, front plate 63, rear plate 64, and side plates 65 and 66.

The bottom plate 62 is arranged in a parallel direction, that is, a horizontal direction with an xy-plane. Furthermore, a plurality of opening sections 621, in which the nozzle ports of the liquid droplet ejection head 23 accommodated in the accommodation section 61 are exposed, are formed in the bottom plate 62.

The front plate 63 is erected from a front surface side of the bottom plate 62, that is, a portion of the positive side of the x-axis toward the upper part.

The rear plate 64 is erected from a rear surface side of the bottom plate 62, that is, a portion of the negative side of the x-axis toward the upper part, while opposing the front plate 63.

The side plate 65 is erected from a portion of the bottom plate 62 at a portion of the positive side of the y-axis toward the upper part.

The side plate 66 is erected from a portion of the bottom plate 62 at the negative side of the y-axis toward upper part, while opposing the side plate 65.

Furthermore, a configuration material of the carriage 6 is not particularly limited, for example, various resin materials or various metal materials can be employed.

The movement unit 22 causes the head unit 5 to reciprocate (move) in a direction orthogonal to (intersecting) the transportation direction with respect to the recording medium 100, that is, the y-axis direction. The configuration of the movement unit 22 is not particularly limited. However, for example, a configuration having the motor, a ball screw connected to the motor, and a linear guide arranged to be parallel with the ball screw can be exemplified. Then, the liquid droplet ejection head 23 reciprocates by the operation of the movement unit 22, while ejecting the ink from the liquid droplet ejection head 23 in a state where the recording medium 100 is transported in the positive direction of the x-axis. Therefore, it is possible to print on the recording medium 100 with the ink.

Furthermore, in the embodiment, if a capping position of the head unit 5 is set to the reference position (standby position), a route through which the head unit 5 moves from the reference position toward the positive direction of the y-axis is referred to as an "outward route", and a route through which the head unit 5 moves from the end point of the outward route toward the reference position again is referred to as a "homeward route". Here, the "capping position" is a position where each nozzle of the liquid droplet ejection head 23 is covered with a cap (not illustrated). It is possible to prevent the ink from drying and the like by the cap. In the embodiment, in FIG. 3, a state where the head unit 5 is located at the capping position is illustrated.

The dry heater 26 is arranged to oppose the platen 24 via the head unit 5. The dry heater 26 irradiates infrared rays toward the ink so as to facilitate drying of the ink during the imparting of the ink onto the recording medium 100.

The dry heater 26 has a tube 261 arranged along the y-axis direction, and the heating unit 262 arranged to be inserted through the inside of the tube 261.

It is preferable that the tube 261 be configured of the metal material, particularly configured of iron. Furthermore, it is preferable that the total length of the tube 261 along the y-axis direction be sufficiently longer than the width of the recording medium 100 along the y-axis direction. Accordingly, it is possible to reliably irradiate infrared rays toward the entirety of the ink on the recording medium 100 passing through the lower part of the tube 261 (dry heater 26).

The heating unit 262 generates heat by electrification, and is configured of, for example, electric heating wire such as a nichrome wire and the like. Then, the tube 261 is heated by the heating unit 262 generating heat, thereby irradiating infrared rays. Accordingly, it is possible to reliably evaporate moisture content in the ink, and thus, the ink can be dried. Furthermore, it is preferable that the heating temperature be, for example, within a range from 400° C. to 800° C., and it is more preferable to be 700° C. or lower, when the tube 261 is heated.

Furthermore, in order to dry the ink on the recording medium 100, although heating from the rear surface side of the recording medium 100, that is, adopting a configuration in which the platen 24 functions as a heating plate can be considered, in this case, a film is generated in the ink due to the property of the ink, and thus, there is a possibility that the evaporation of the moisture content in the ink is hindered by the film. Accordingly, it is preferable to have a configuration that heats from the front surface side of the recording medium 100 as in the embodiment when drying the ink.

The blower fan 27 is arranged at the upstream side in the transportation direction on the upper portion of the apparatus main body 2. The blower fan 27 blows out wind 271 along the transportation direction. By the wind 271, it is possible to push out the vapor generated by heating the ink to the outside of the apparatus main body 2. Accordingly, for example, it is possible to prevent condensation from being generated onto the liquid droplet ejection head 23.

Furthermore, as the blower fan 27, similar to the suction fan 28, for example, various kinds of fans such as a multi-blade fan and the like can be employed.

The apparatus main body 2 having the above-described configuration is supported by the leg section 3 from the lower side thereof (see FIG. 1). The leg section 3 is configured to include a frame section 31, four casters 32 and two adjuster feet (fixture) 33.

The frame section 31 is an assembly in which a plurality of rod-shaped members 311 are properly connected to each other to be fixed and assembled.

Each caster 32 is arranged and fixed at the lower portion of the frame section 31 so as to be separated from each other. Accordingly, it is possible to transport the printing apparatus 1.

In addition, each adjuster foot 33 is also fixed to the lower portion of the frame section 31. Each adjuster foot 33 is respectively arranged in the vicinity of two casters 32 located at the negative side of the x-axis among four casters 32. When regulating, that is, fixing the movement of the printing apparatus 1 after transporting the printing apparatus 1, it is possible to perform the regulation by causing each adjuster foot 33 to respectively abut on the floor.

The curing unit 4 is arranged at the downstream side in the transportation direction with respect to the apparatus main body 2. As illustrated in FIG. 2, the curing unit 4 has a curing heater 41, a cooling fan 42, and a casing (housing) 43.

The casing 43 is a boxlike member collectively accommodating the curing heater 41 and the cooling fan 42. In addition, an outer shape of the casing 43 (curing unit 4) is long-shaped along the y-axis direction, and the length thereof is shorter than that of the casing 29 (apparatus main body 2).

In addition, a passage 432 through which the recording medium 100 passes is provided in the casing 43. An end point of the passage 432 is a discharge port 433 from which the recording medium 100 is discharged.

In the middle of the passage 432, the curing heater 41 is arranged on a side of the recording medium 100, passing through the passage 432, onto which the ink is imparted, that is, a front surface side of the recording medium 100. The curing heater 41 irradiates infrared rays toward the ink on the recording medium 100 such that the ink is heated so as to be cured. Then, the ink is reliably fixed onto the recording medium 100 by the curing.

As illustrated in FIG. 2, the curing heater 41 has a tube 411 arranged along the y-axis direction, and a heating unit 412 inserted through the inside of the tube 411.

It is preferable that the tube 411 is configured of the metal material, particularly configured of iron. Furthermore, it is preferable that the total length of the tube 411 along the y-axis direction be sufficiently longer than the width of the recording medium 100 along the y-axis direction. Accordingly, it is possible to reliably irradiate infrared rays toward the entirety of the ink on the recording medium 100 passing through the lower part of the tube 411 (curing heater 41).

The heating unit 412 generates heat by electrification, and is configured of, for example, the electric heating wire such as the nichrome wire and the like. Then, the tube 411 is heated by the heating unit 412 generating heat, thereby irradiating infrared rays. Accordingly, the resin component in the ink is cured. Accordingly, a printed matter, that is, the recording medium 100 on which the ink is cured becomes excellent in weather resistance and friction resistance.

Furthermore, it is preferable that the surface temperature of the recording medium 100 when heating be, for example, within a range from 60° C. to 120° C., and it is more preferable to be within a range from 80° C. to 100° C.

In addition, it is possible to detect the surface temperature of the recording medium 100 by using, for example, an infrared ray sensor (IR sensor). Moreover, it is possible to set the surface temperature of the recording medium 100 to be within the above-mentioned range by properly switching ON/OFF of the curing heater 41 on the basis of the detection result of the infrared ray sensor.

The cooling fan 42 is arranged at the downstream side in the transportation direction with respect to the curing heater 41. The cooling fan 42 sends wind toward the recording medium 100 heated by the curing heater 41, thereby cooling off the recording medium 100.

Furthermore, as the cooling fan 42, similar as the blower fan 27 and the suction fan 28, for example, various kinds of fans such as a multi-blade fan and the like can be employed.

Meanwhile, as described above, the apparatus main body 2 has the warpage straightening member 7. The warpage straightening member 7 is a member to straighten a warpage 101 to disappear in a case where the warpage 101 occurs on a portion of the recording medium 100, that is, a portion of the recording medium 100 is loosened from the upper surface 241 of the platen 24, when performing printing onto the recording medium 100 (see FIGS. 3, 4 and 8A to 8D).

Furthermore, the warpage 101 often occurs in the vicinity of the downstream side of a portion of the recording medium 100 clamped by the rollers 211 and 212. Then, although depending on the degree thereof, the warpage 101 interferes, that is, collides with the head unit 5 moved by operation of the movement unit 22. As a result, there has been a problem that retention (jamming) of the recording medium 100 occurs so as to cause the head unit 5 to be held in suspension in its integrity, thereby causing throughput (operation efficiency)

to be lowered. As a cause of the occurrence of the warpage 101, for example, various conditions such as a relatively high humidity in the use environment where the printing apparatus 1 is used can be considered.

As illustrated in FIGS. 3 to 7, the warpage straightening member 7 is configured of a long plate member along the y-axis direction, and fixedly provided on the lower surface (rear surface) of the bottom plate 62 of the carriage 6 of the head unit 5. Accordingly, the warpage straightening member 7 is arranged to oppose the recording medium 100 when the head unit 5 passes through above the recording medium 100, and thus, the warpage 101 on the recording medium 100 can be straightened (see FIGS. 8A to 8D). The process of straightening the warpage 101 will be described below.

Furthermore, a fixing method of the warpage straightening member 7 with respect to the carriage 6 is not particularly limited, for example, a bolt fastening (screwing) method, an adhesion (adhesion using an adhesive or a solvent) method, a fusion (heat fusion, high frequency fusion, ultrasonic fusion or the like) method, and an engagement method can be exemplified.

In addition, the configuration material of the warpage straightening member 7 is not particularly limited. However, for example; a metal material such as aluminum or an aluminum alloy, and stainless steel; and a resin material such as polyethylene, and polypropylene can be exemplified.

In addition, although depending on the configuration material, it is preferable that the maximum thickness of the warpage straightening member 7 be, for example, 5 mm or thicker and 30 mm or thinner, and it is more preferable to be 10 mm or thicker and 20 mm or thinner.

The length of the warpage straightening member 7 is longer than that of the head unit 5 along the y-axis direction. Then, in both of the end portions of the warpage straightening member 7, pressing sections 71*a* and 71*b* which press the warpage 101 from the positive direction of the x-axis, that is, the direction from the upstream side toward the downstream side of the transportation direction are respectively provided.

As illustrated in FIG. 3, the pressing section (first pressing section) 71*a* is located in front of the warpage straightening member 7 in the travel direction on the outward route. Then, the pressing section 71*a* can reliably press the warpage 101 from the upstream side toward the downstream side in the transportation direction on the outward route, that is, in accordance with the head unit 5 moving (passing through) toward the positive direction of the y-axis over the recording medium 100. The warpage 101 is straightened and disappears by the pressing.

As illustrated in FIG. 4, the pressing section (second pressing section) 71*b* is located in front of the warpage straightening member 7 in the travel direction on the homeward route. Then, the pressing section 71*b* can reliably press the warpage 101 from the upstream side toward the downstream side in the transportation direction on the homeward route, that is, in accordance with the head unit 5 moving toward the negative direction of the y-axis over the recording medium 100. The warpage 101 is straightened and disappears by the pressing (see FIGS. 8A to 8D).

In addition, as illustrated in FIG. 5, the pressing section 71*a* protrudes from the head unit 5 toward the positive direction (left side in FIG. 5) of the y-axis in a plan view of the warpage straightening member 7. Accordingly, on the outward route, the pressing section 71*a* can squash the warpage 101 before the head unit 5 interferes with the warpage 101. Therefore, it is possible to reliably prevent the head unit 5 from being interfered with the warpage 101.

Meanwhile, the pressing section 71*b* protrudes from the head unit 5 toward the negative direction (right side in FIG. 5) of the y-axis in a plan view of the warpage straightening member 7. Accordingly, on the homeward route, the pressing section 71*b* can squash the warpage 101 before the head unit 5 is interfered with the warpage 101. Therefore, it is possible to reliably prevent the head unit 5 from being interfered with the warpage 101.

The protrusion amount (protruding length) $L_1$ of the pressing section 71*a* and the protrusion amount (protruding length) $L_2$ of the pressing section 71*b* are different from each other in the configuration illustrated in FIG. 5 such that the protrusion amount $L_1$ is shorter than the protrusion amount $L_2$. However, without being limited thereto, for example, the protrusion amounts $L_1$ and $L_2$ may be the same. In addition, it is preferable that the protrusion amounts $L_1$ and $L_2$ be respectively 90 mm or shorter, and more preferable to be in a range of 40 mm or longer and 85 mm or shorter.

In addition, since the pressing section 71*a* and the pressing section 71*b* have the same configuration except different arrangement positions from each other, that is, the pressing section 71*a* and the pressing section 71*b* have first tilted sections (tilted portions) 72 and second tilted sections (tilted portions) 73, hereinafter, the first tilted sections 72 and the second tilted section 73 of the pressing section 71*a* will be representatively described.

The first tilted section 72 is formed at a portion of pressing section 71*a* at the positive side of the x-axis, that is, at a portion of the downstream side in the transportation direction. As illustrated in FIG. 5, the first tilted section 72 is tilted so as to form an acute angle with respect to the y-axis direction in a plan view, that is, the movement direction of the head unit 5. Although depending on the weight of the head unit 5 or the moving velocity of the head unit 5, for example; when the weight of the head unit 5 is within a range from 500 g by weight to 3 kg by weight or smaller, and the moving velocity of the head unit 5 is within a range from 230 cm/sec to 1330 cm/sec; and it is preferable that the angle $\theta_1$ of the first tilted section 72 be within a range from 50 degrees to 70 degrees, and it is more preferable to be within a range from 60 degrees to 70 degrees.

On the outward route, the first tilted section 72 formed in the above-mentioned manner can be easily thrust into a relatively narrow space between the warpage 101 and the roller 212. Then if the head unit 5 moves in its integrity, the warpage 101 can be easily and reliably pressed by the first tilted section 72 such that the warpage 101 can reliably disappear.

The angle $\theta_1$ of the first tilted section 72 of the pressing section 71*a* and the angle $\theta_1$ of the first tilted section 72 of the pressing section 71*b* are different from each other in the configuration illustrated in FIG. 5 such that the former angle is greater than the latter angle. However, without being limited thereto, for example, the former and latter angles may be the same.

The second tilted section 73 is formed at a portion opposing the recording medium 100, that is, a lower portion of the pressing section 71*a*. As illustrated in FIG. 6, the second tilted section 73 is tilted so as to form an acute angle with respect to the y-axis direction in a plan view in which the warpage straightening member 7 is viewed from the downstream side in the transportation direction, that is, the movement direction of the head unit 5. Although depending on the weight of the head unit 5 or the moving velocity of the head unit 5, for example; when the weight of the head unit 5 is within a range from 500 g by weight to 3 kg by weight, and the moving velocity of the head unit 5 is within a range from 230 cm/sec to 1330 cm/sec; and it is preferable that the angle $\theta_2$ of the second tilted section 73 be within a range from 30 degrees to 50 degrees, and it is more preferable to be within a range from 35 degrees to 45 degrees.

Then, on the outward route, the warpage straightening member 7 (the head unit 5) can easily surmount the portion of the upstream side from the warpage 101 of the recording medium 100 on the second tilted section 73 which is formed in the above-mentioned manner.

The angle $\theta_2$ of the second tilted section 73 of the pressing section 71*a* and the angle $\theta_2$ of the second tilted section 73 of the pressing section 71*b* are the same as each other in the configuration illustrated in FIG. 5. However, without being limited thereto, for example, the angles may be different from each other.

In addition, an opening section 74 is formed at a portion facing each opening section 621 of the carriage 6 in the warpage straightening member 7 (for example, see FIG. 7).

Next, the process in which the warpage 101 of the recording medium 100 is straightened by the warpage straightening member 7 will be described referring to FIGS. 8A to 8D.

Figure 8A:
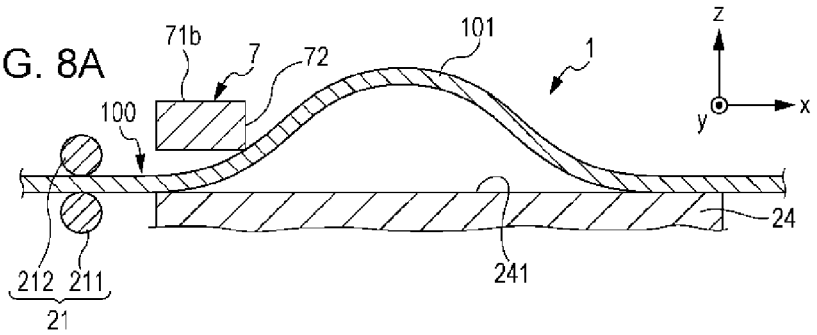
FIGS. 8A to 8D are cross-sectional views (views illustrating a process in which a warpage of a recording medium is straightened) taken along lines VIIIA-VIIIA, VIIIB-VIIIB, VIIIC-VIIIC, and VIIID-VIIID in FIG. 4.

[1] As illustrated in FIG. 8A, in the recording medium 100, the warpage 101 occurs on the platen 24. In addition, the recording medium 100 is clamped by the rollers 211 and 212 at a portion of the upstream side thereof. Accordingly, the recording medium 100 is in the cantilevered state.

Then, if the head unit 5 moves in the negative direction of the y-axis to perform printing onto the recording medium 100 from the above-described state, the warpage straightening member 7 moves in the same direction as with the head unit 5. At that time, the first tilted section 72 of the pressing section 71*b* is thrust into a relatively narrow space between the warpage 101 and the roller 212.

Figure 8B:
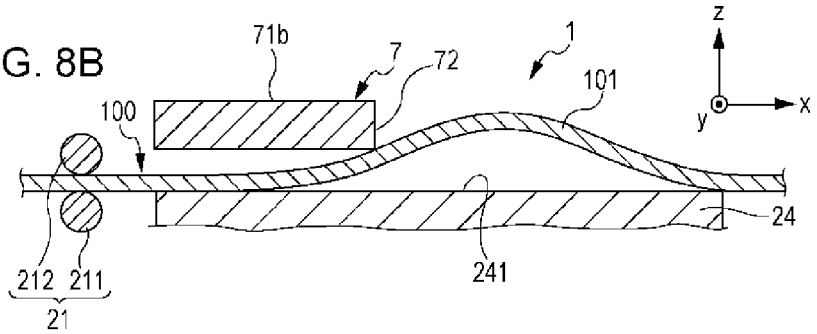
Figure 8C:
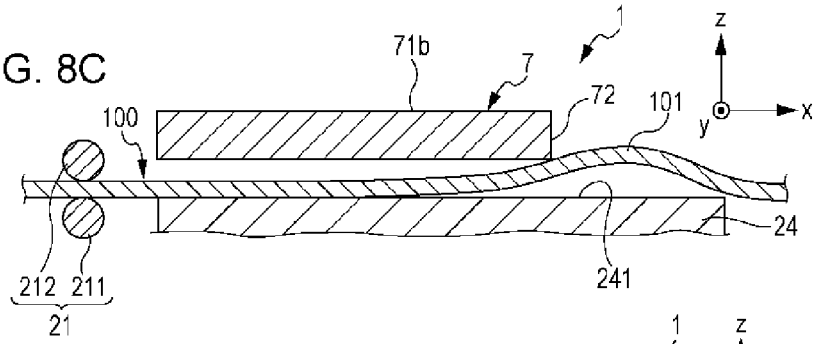

[2] Moreover, if the head unit 5 continues to move in the negative direction of the y-axis, as illustrated in FIGS. 8B and 8C, the warpage straightening member 7 starts to press the warpage 101 with the first tilted section 72 of the pressing section 71*b* toward the positive direction of the x-axis.

As described above, the recording medium 100 is cantilevered at the upstream side thereof. Therefore, the warpage 101 is gradually straightened toward the downstream side by being pressed with the first tilted section 72.

Figure 8D:
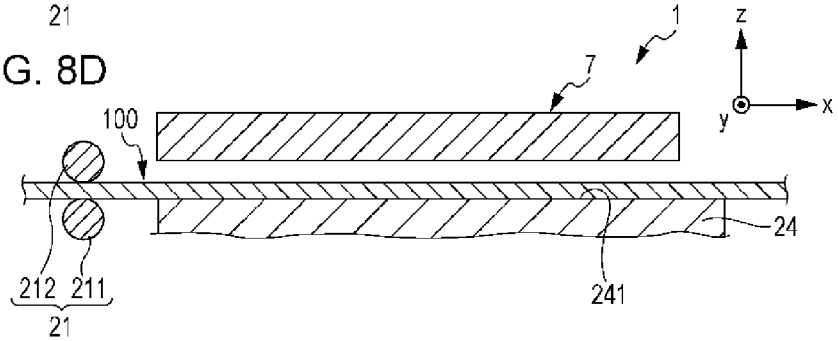

[3] Then, as illustrated in FIG. 8D, the warpage 101 finally disappears from the recording medium 100.

Furthermore, the head unit 5 can impart the ink onto the recording medium 100 from which the warpage 101 is removed during the movement process.

In this manner, in the printing apparatus 1 when performing printing onto the recording medium 100, even in a case where the warpage 101 occurs on the recording medium 100, the warpage 101 can reliably disappear. Accordingly, retention (jamming) of the recording medium 100 can be reliably prevented from occurring due to an inadvertent warpage of the recording medium 100.

In addition, in the printing apparatus 1, since the head unit 5 can move while gradually removing the warpage 101, it is possible to reduce the load upon the motor of the movement unit 22, which can be generated by a collision between the head unit 5 and the warpage 101.

Second Embodiment

Figure 9:
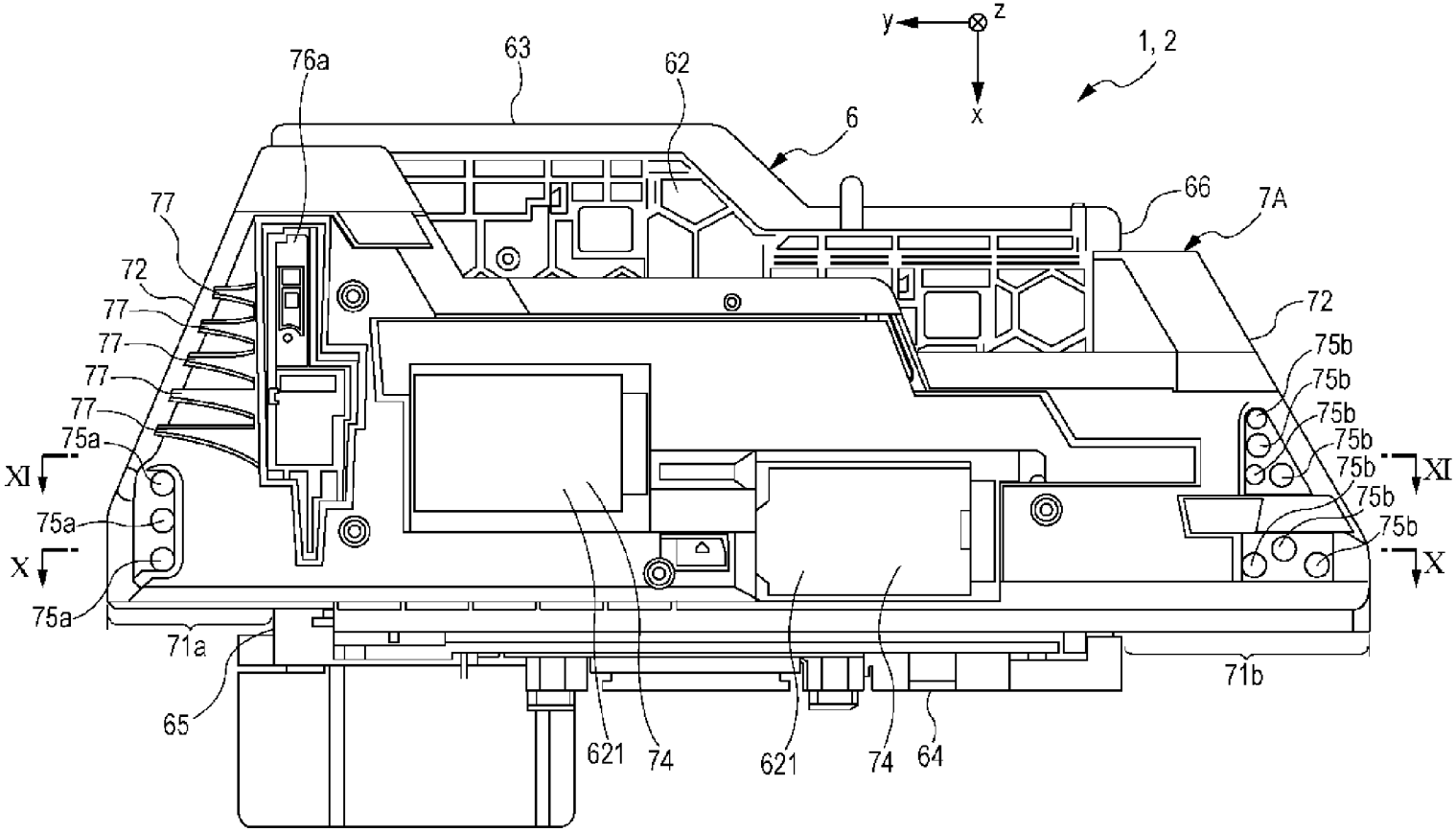
FIG. 9 is a bottom view of a head unit included in a printing apparatus of an aspect of the invention (second embodiment).
Figure 10:
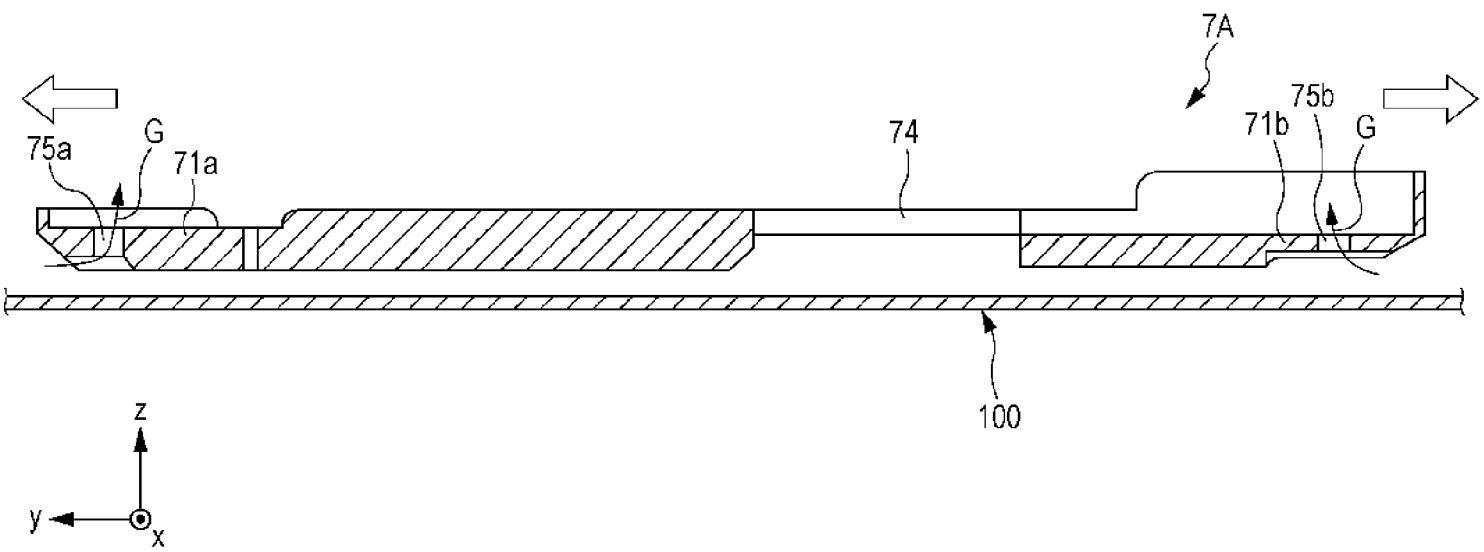
FIG. 10 is a cross-sectional view taken along line X-X in FIG. 9.
Figure 11:
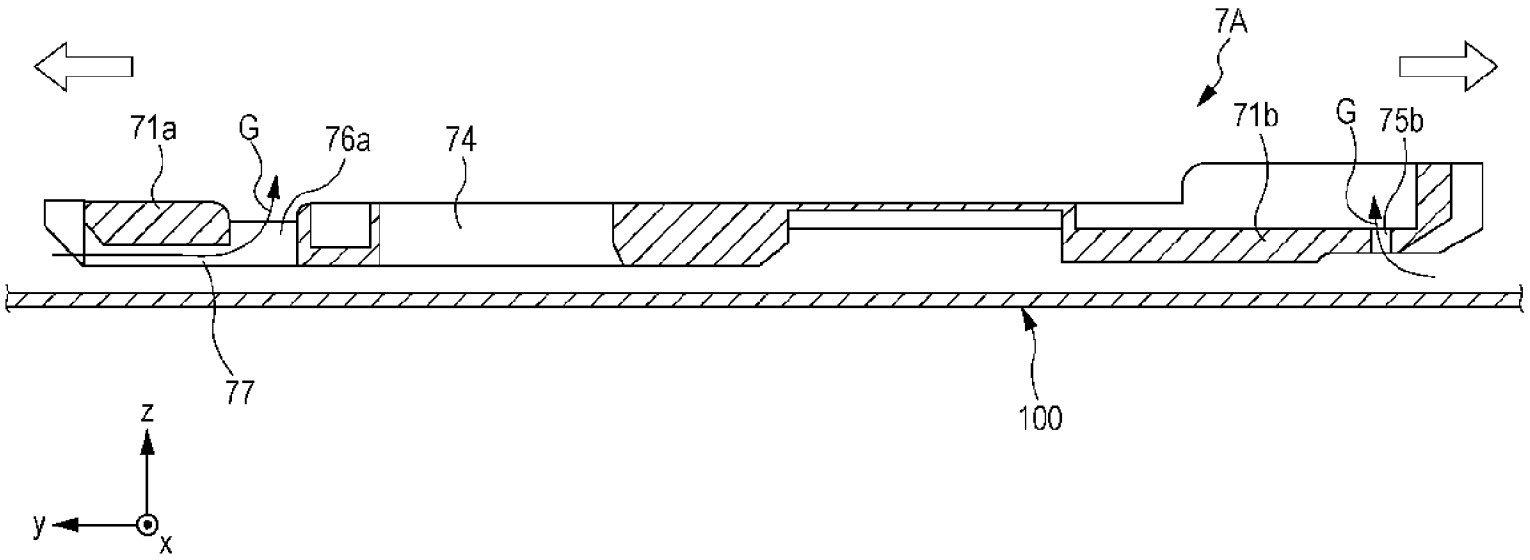
FIG. 11 is a cross-sectional view taken along line XI-XI in FIG. 9.

FIG. 9 is a bottom view of a head unit included in a printing apparatus of an aspect of the invention (second embodiment), FIG. 10 is a cross-sectional view taken along line X-X in FIG. 9, and FIG. 11 is a cross-sectional view taken along line XI-XI in FIG. 9.

Hereinafter, the second embodiment of the printing apparatus of the aspect of the invention will be described referring to FIGS. 9 to 11. However, the description will focus on differences from the embodiment described above, and similar matter thereof will not be described.

The present embodiment is the same as the first embodiment except for differences in configuration of a warpage straightening unit.

As illustrated in FIG. 9, a plurality of through holes 75*a* (three in the illustrated configuration), which pass through a warpage straightening member 7A in the thickness direction, are formed in a pressing section 71*a* of the warpage straightening member 7A.

Each through hole 75*a* is respectively circular-shaped in a plan view. In addition, in the warpage straightening member 7A, a through hole 76*a* which is larger than the through holes 75*a* is formed in the vicinity of each through hole 75*a*.

The through hole 76*a* is long-shaped in a plan view along the x-axis direction.

As illustrated in FIGS. 10 and 11, if the warpage straightening member 7A moves toward the positive direction of the y-axis together with the head unit 5, air G (wind) flows in between the warpage straightening member 7A and the recording medium 100. At that time, the air G is to be discharged from between the warpage straightening member 7A and the recording medium 100 through the through holes 75*a* and 76*a*. Accordingly, it is possible to reliably prevent curved flying of the ink from occurring by the air G flowed into between the warpage straightening member 7A and the recording medium 100. Here, the "curved flying of an ink" denotes a state where the ink is not dropped on a designated position due to a certain external disturbance. The curved flying of the ink causes a hindrance of landing of the ink in a predetermined position on the recording medium 100.

As illustrated in FIG. 9, in the rear surface of the warpage straightening member 7A, a plurality of guide grooves 77 (five in the illustrated configuration in FIG. 9), are formed which are extended from the first tilted section 72 side along the y-axis direction and communicates with the through hole 76*a*. Each guide groove 77 is a portion which respectively guides the air G toward the through hole 76*a*.

As illustrated in FIG. 11, the air G flowed in between the warpage straightening member 7A and the recording medium 100 is reliably introduced to the through hole 76*a* by each guide groove 77, and discharged from the through hole 76*a*.

Furthermore, it is preferable that the width of the guide grooves 77 be gradually increased toward the through hole 76*a*.

In addition, a plurality of through holes 75*b* (seven in the illustrated configuration in FIG. 11) passing through the warpage straightening member 7A in the thickness direction thereof are individually formed in the pressing section 71*b*. Each through hole 75*b* is respectively circular-shaped in a plan view.

As illustrated in FIGS. 10 and 11, if the warpage straightening member 7A moves toward the negative direction of the y-axis together with the head unit 5, the air G flows in between the warpage straightening member 7A and the recording medium 100. At that time, the air G is to be discharged from between the warpage straightening member 7A and the recording medium 100 through the through holes 75*b*. Accordingly, it is possible to reliably prevent the curved flying of the ink from occurring by the air G flowed in between the warpage straightening member 7A and the recording medium 100.

Furthermore, although the number of formations of the through holes formed in the warpage straightening member 7A is more than one in the embodiment, without being limited thereto, for example, the number of the formation can be one.

Third Embodiment

Figure 12:
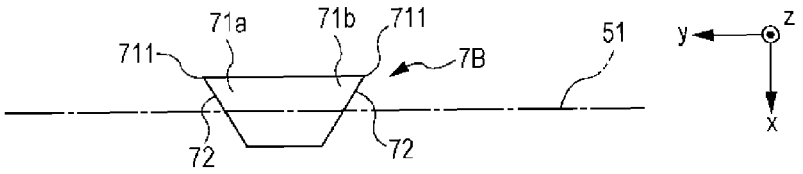
FIG. 12 is a plan view of a warpage straightening member (warpage straightening unit) included in a printing apparatus of an aspect of the invention (third embodiment).

FIG. 12 is a plan view of a warpage straightening member (warpage straightening unit) included in a printing apparatus of an aspect of the invention (third embodiment).

Hereinafter, the third embodiment of the printing apparatus in the invention will be described referring to FIG. 12. However, the description will focus on differences from the embodiments described above, and similar matter thereof will not be described.

The present embodiment is the same as the first embodiment except for differences in the shape of the warpage straightening member in a plan view.

As illustrated in FIG. 12, a warpage straightening member 7B has a trapezoidal shape in a plan view. Then, apexes 711 of the pressing sections 71*a* and 71*b* are located at the negative side of the x-axis from the center line 51 of the head unit 5. Here, in the embodiment, the "center line" denotes a line bisecting the maximum length of the head unit 5 in the x-axis direction.

The warpage straightening member 7B having the above-described shape can also remove the warpage 101 in the recording medium 100. Accordingly, it is possible to reliably prevent retention of the recording medium 100 under printing.

Fourth Embodiment

Figure 13:
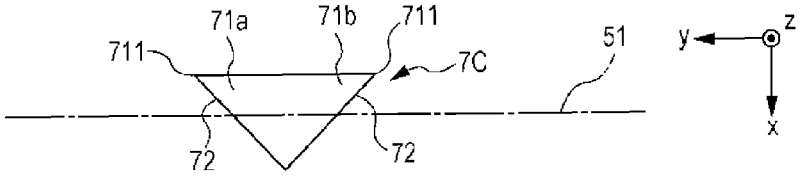
FIG. 13 is a plan view of a warpage straightening member (warpage straightening unit) included in a printing apparatus of an aspect of the invention (fourth embodiment).

FIG. 13 is a plan view of a warpage straightening member (warpage straightening unit) included in a printing apparatus of an aspect of the invention (fourth embodiment).

Hereinafter, the fourth embodiment of the printing apparatus in the invention will be described referring to FIG. 13. However, the description will focus on differences from the embodiments described above, and similar matter thereof will not be described.

The present embodiment is the same as the third embodiment except for differences in the shape of the warpage straightening member in a plan view.

As illustrated in FIG. 13, a warpage straightening member 7C has a triangular shape in a plan view. Then, the apexes 711 of the pressing sections 71*a* and 71*b* are located at the negative side of the x-axis from the center line 51 of the head unit 5.

The warpage straightening member 7C having the above-described shape can also remove the warpage 101 in the recording medium 100. Accordingly, it is possible to reliably prevent retention of the recording medium 100 under printing.

Fifth Embodiment

Figure 14:
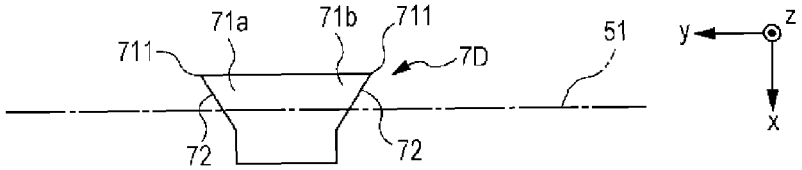
FIG. 14 is a plan view of a warpage straightening member (warpage straightening unit) included in a printing apparatus of an aspect of the invention (fifth embodiment).

FIG. 14 is a plan view of a warpage straightening member (warpage straightening unit) included in a printing apparatus of an aspect of the invention (fifth embodiment).

Hereinafter, the fifth embodiment of the printing apparatus in the invention will be described referring to FIG. 14. However, the description will focus on differences from the embodiments described above, and similar matter thereof will not be described.

The present embodiment is the same as the first embodiment except for differences in the shape of the warpage straightening member in a plan view.

As illustrated in FIG. 14, a warpage straightening member 7D has the substantially same shape in a plan view as a SAKE cup in a side view. Then, the apexes 711 of the pressing sections 71*a* and 71*b* are located at the negative side of the x-axis from the center line 51 of the head unit 5.

The warpage straightening member 7D having the above-described shape can also remove the warpage 101 in the recording medium 100. Accordingly, it is possible to reliably prevent retention of the recording medium 100 under printing.

Sixth Embodiment

Figure 15:
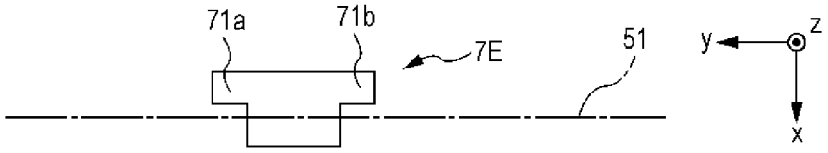
FIG. 15 is a plan view of a warpage straightening member (warpage straightening unit) included in a printing apparatus of an aspect of the invention (sixth embodiment).

FIG. 15 is a plan view of a warpage straightening member (warpage straightening unit) included in a printing apparatus of an aspect of the invention (sixth embodiment).

Hereinafter, the sixth embodiment of the printing apparatus in the invention will be described referring to FIG. 15. However, the description will focus on differences from the embodiments described above, and similar matter thereof will not be described.

The present embodiment is the same as the first embodiment except for differences in the shape of the warpage straightening member in a plan view.

As illustrated in FIG. 15, a warpage straightening member 7E has the "T" shape in a plan view. Then, the pressing sections 71*a* and 71*b* are located at the negative side of the x-axis from the center line 51 of the head unit 5.

The warpage straightening member 7E having the above-described shape can also remove the warpage 101 in the recording medium 100. Accordingly, it is possible to reliably prevent retention of the recording medium 100 under printing.

Seventh Embodiment

Figure 16:
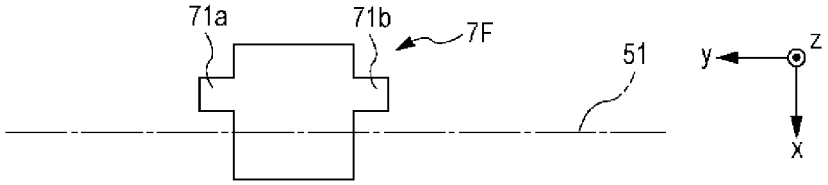
FIG. 16 is a plan view of a warpage straightening member (warpage straightening unit) included in a printing apparatus of an aspect of the invention (seventh embodiment).

FIG. 16 is a plan view of a warpage straightening member (warpage straightening unit) included in a printing apparatus of an aspect of the invention (seventh embodiment).

Hereinafter, the seventh embodiment of the printing apparatus in the invention will be described referring to FIG. 16. However, the description will focus on differences from the embodiments described above, and similar matter thereof will not be described.

The present embodiment is the same as the first embodiment except for differences in the shape of the warpage straightening member in a plan view.

As illustrated in FIG. 16, a warpage straightening member 7F has a cross shape in a plan view. Then, the pressing sections 71*a* and 71*b* are located at the negative side of the x-axis from the center line 51 of the head unit 5.

The warpage straightening member 7F having the above-described shape can also remove the warpage 101 in the recording medium 100. Accordingly, it is possible to reliably prevent retention of the recording medium 100 under printing.

Eighth Embodiment

Figure 17:
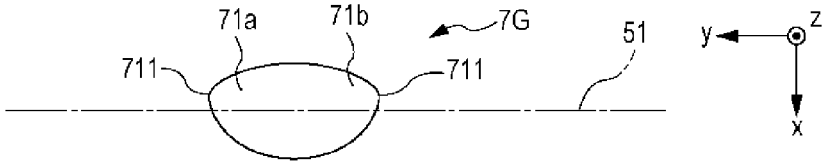
FIG. 17 is a plan view of a warpage straightening member (warpage straightening unit) included in a printing apparatus of an aspect of the invention (eighth embodiment).

FIG. 17 is a plan view of a warpage straightening member (warpage straightening unit) included in a printing apparatus of an aspect of the invention (eighth embodiment).

Hereinafter, the eighth embodiment of the printing apparatus in the invention will be described referring to FIG. 17. However, the description will focus on differences from the embodiments described above, and similar matter thereof will not be described.

The present embodiment is the same as the first embodiment except for differences in the shape of the warpage straightening member in a plan view.

As illustrated in FIG. 17, a warpage straightening member 7G has a rugby-ball shape in a plan view. Then, the apexes 711 of the pressing sections 71*a* and 71*b* are located at the negative side of the x-axis from the center line 51 of the head unit 5.

The warpage straightening member 7G having the above-described shape can also remove the warpage 101 in the recording medium 100. Accordingly, it is possible to reliably prevent retention of the recording medium 100 under printing.

Hereinbefore, the printing apparatus of some aspects of the invention has been described referring to the illustrated embodiments. However, the invention is not limited thereto such that each component configuring the printing apparatus can be replaced by arbitrary configurations which can perform similar functions. In addition, an arbitrary component part may be added thereto.

In addition, the printing apparatus of the aspect of the invention may be assembled with two or more arbitrary configurations (features) among the above-described embodiments.

The warpage straightening member is separately configured from a head unit (carriage) and a head in the respective embodiments described above. However, without being limited thereto, for example, the warpage straightening member may be integrally formed with the head unit (carriage).

This application claims priority to Japanese Patent Application No. 2012-232421 filed on Oct. 19, 2012. The entire disclosure of Japanese Patent Application No. 2012-232421 is hereby incorporated herein by reference.

What is claimed is:

1. A printing apparatus comprising:

a transportation unit that transports a recording medium having flexibility; a head unit that has a liquid droplet ejection head which ejects an ink onto the recording medium transported by operation of the transportation unit, and a carriage which supports the liquid droplet ejection head;

a movement unit that moves the head unit in a moving direction intersecting a transportation direction of the recording medium with respect to the recording medium; and a warpage straightening unit that straightens a warpage to disappear when the warpage in a degree to interfere with the head unit which is moved by operation of the movement unit, occurs in the recording medium, wherein the warpage straightening unit is provided in the head unit, and configured of a plate member which is arranged to oppose the recording medium when the head unit passes over the recording medium, wherein the plate member has pressing sections that press the warpage, wherein the pressing sections have a tilted section at a portion of the downstream side in the transportation direction, the tilted section being tilted to form an angle toward the moving direction in a planar view, and wherein the tilted section presses the warpage toward the downstream in the transportation direction in accordance with the head unit passing over the recording medium in the moving direction, wherein the angle of the tilted section is configured based upon a velocity of the head unit.

2. The printing apparatus according to claim 1, wherein the movement unit is configured to cause the head unit to reciprocate in a direction intersecting the transportation direction, and the pressing sections are respectively provided on a portion which is located in front of the plate member on an outward route and a portion which is located in front of the plate member on a homeward route.

3. The printing apparatus according to claim 1, wherein the pressing sections protrude from the head unit in a plan view of the plate member.

4. The printing apparatus according to claim 1, wherein the angle of the tilted section is within a range from 50 degrees to 70 degrees.

5. The printing apparatus according to claim 1, wherein at least one through hole that passes through the plate member is formed in the plate member, and configured to allow air to be discharged from between the plate member and the recording medium through the through hole, if the air flows in between the plate member and the recording medium.

6. The printing apparatus according to claim 5, wherein a guide groove that guides the air toward the through hole is formed in the plate member.

7. The printing apparatus according to claim 1, wherein the warpage straightening unit is comprised of a first protrusion member that protrudes from the head unit and a second protrusion member that protrudes from the head unit, wherein a protrusion amount of the first protrusion member is different than a protrusion amount of the second protrusion member.

* * * * *